US007942136B2

(12) United States Patent
Lepsch et al.

(10) Patent No.: US 7,942,136 B2
(45) Date of Patent: May 17, 2011

(54) FUEL-HEATING ASSEMBLY AND METHOD FOR THE PRE-HEATING OF FUEL AN INTERNAL COMBUSTION ENGINE

(76) Inventors: Fernando Lepsch, Campinas (BR); Fernando Marron, Salto (BR); Franz Thommes, Alemanha (DE); Rosalvo Bertolucci Filho, Campinas (BR); Alvaro Augusto Vasconcelos, Bairro Chacara Primavera (BR); Marcos Melo Araujo, Campinas (BR); Marcello Francisco Brunocilla, Indaiatuba (BR)

( * ) Notice: Subject to any disclaimer, the term of this patent is extended or adjusted under 35 U.S.C. 154(b) by 830 days.

(21) Appl. No.: 11/921,696

(22) PCT Filed: Jun. 5, 2006

(86) PCT No.: PCT/BR2006/000110

§ 371 (c)(1),
(2), (4) Date: Dec. 6, 2007

(87) PCT Pub. No.: WO2006/130938

PCT Pub. Date: Dec. 14, 2006

(65) Prior Publication Data

US 2009/0133676 A1 May 28, 2009

(30) Foreign Application Priority Data

Jun. 6, 2005 (BR) ..... 0502146
Feb. 15, 2006 (BR) ..... 0600645

(51) Int. Cl.
*F02M 60/50* (2006.01)

(52) U.S. Cl. ..... 123/549; 123/557

(58) Field of Classification Search ..... 123/549, 123/557, 179.21
See application file for complete search history.

(56) References Cited

U.S. PATENT DOCUMENTS

| | | | | |
|---|---|---|---|---|
| 5,216,990 | A * | 6/1993 | Moosmann et al. | 123/145 A |
| 5,529,035 | A * | 6/1996 | Hunt et al. | 123/179.15 |
| H1820 | H | 12/1999 | Graves et al. | |
| 6,209,500 | B1 * | 4/2001 | Tallio et al. | 123/179.21 |
| 7,669,585 | B2 * | 3/2010 | Haag et al. | 123/456 |
| 2003/0234004 | A1 * | 12/2003 | Forgue et al. | 123/460 |

FOREIGN PATENT DOCUMENTS

| | | |
|---|---|---|
| DE | 101 05 760 | 9/2002 |
| JP | 08 338339 | 12/1996 |
| WO | WO 2005/024225 | 3/2005 |

OTHER PUBLICATIONS

The International Search Report for PCT Application No. PCT/BR2006/000110; Filed Jun. 5, 2006.
The Written Opinion for PCT Application No. PCT/BR2006/000110; Filed Jun. 5, 2006.
Statement Under Article 19(1) submitted to World Intellectual Property Organization (WIPO) on Nov. 10, 2006.
The International Preliminary Examination Report on Patentability, Date of Submission Apr. 5, 2007; Date of Completion Oct. 9, 2007. Submission to the European Patent Office Dated Sep. 21, 2007.

* cited by examiner

*Primary Examiner* — M. McMahon
(74) *Attorney, Agent, or Firm* — Alston & Bird LLP

(57) ABSTRACT

A heating assembly that allows an adequate pre-heating of a fuel used in an internal combustion engine is disclosed.

30 Claims, 20 Drawing Sheets

FUEL-HEATING ASSEMBLY AND METHOD FOR THE PRE-HEATING OF FUEL AN INTERNAL COMBUSTION ENGINE

The present invention refers to a fuel-heating assembly and to a method for the pre-heating of fuel for an internal combustion engine. Said assembly and method are employed mainly in engines that consume fuels with high specific heat of vaporization.

DESCRIPTION OF THE STATE-OF-THE-ART

Nowadays, Otto cycle internal combustion engines, that use alcohol fuel, have systems and devices for aiding the cold start thereof. These engines do not, necessarily, consume only alcohol, but may also consume a blend in any proportion of alcohol and gasoline, which are commercially known as flex-fuel, trifuel, dual-fuel or tri-fuel.

Thus, when a high percentage of alcohol, or pure alcohol, is used, the cold start system must be activated for aiding in the cold start of the engine. This system consists, basically, in the gasoline injection at some admission component of the engine, such as, for example, the intake manifold or the combustion chamber itself.

The use of gasoline is due to the fact that it has a specific heat of vaporization lower than alcohol, thus it becomes unnecessary the withdrawal of too much heat from the environment. This is what in fact prevents the alcohol vaporization, once it has a high specific heat of vaporization, so, when injected in the engine at low temperatures, it condensates.

Due to this condensation, the vaporization thereof is highly difficult in such a way that the sparkle provided by a ignition system through an spark plug is not enough to provoke an efficient combustion, therefore, preventing the engine from entering an operating state.

Thus, for the injection of gasoline to be carried out, a second fuel compartment with a lower volume than the one of the main tank is used, this second compartment being installed, usually in the vault of the engine of a vehicle, what takes up a significant amount of room.

Furthermore, in this start system it is necessary the use of other components, such as, for example, auxiliary fuel pump, solenoid valves, or, still, additional piping, what significantly increases the total cost of the engine which is aimed at consuming alcohol as fuel and that has a satisfactory start. Likewise, the use of additional piping increases the risk of fuel leaking accidents, because, due to the fact of a higher amount of pipes with fuels, the possibility of fuel leaking during an accident increases, what naturally increases the risks to passengers and to the driver. Furthermore, it must be noted that the gasoline contained in the second compartment may age in case it is not regularly used, making it possible, therefore, a poor operation of the cold start.

Another setback in the systems that use an additional start fuel is the fact that this fuel has to be, due to the costs, injected in the intake manifold of the internal combustion engine. This injection in the manifold increases the potential for the phenomenon of an early explosion of the fuel in the admission collector (backfire), damaging this component and decreasing the useful life thereof.

Another aspect, which must be observed, is the air/fuel ratio that is used during the heating phase of an internal combustion engine. This ratio must be kept below stoichmetric, having, thus a "rich" blend which allows an adequate heating of the engine that uses gasoline as well as alcohol.

During heating, the proportion has to reach a value close to stoichmetric. However, it can only reach it when the engine is already properly heated.

It happens that, due to the fact that the proportion is kept below stoichmetric, the emissions of hydrocarbons (HC) and of other pollutants are very high until the heating of the engine. These emissions, during the heating phase, correspond to approximately 90% of the emissions generated by internal combustion engine on average. Such emissions decrease the possibility of reaching governmental goals for emissions, which are getting stricter due to environmental reasons.

It must be further observed that during the heating of the engine the catalyst is still cold, what harms the efficiency of the operation thereof and consequent emissions reduction.

Thus, in order to avoid high levels of emissions, as well as optimize the cold start of the engine, without needing the use of an auxiliary start system (secondary fuel), there have been several attempts at heating the fuel before the injection thereof in the cylinder of the internal combustion engine.

A first attempt was to try to use the same technology employed in diesel cycle engines, which consists of heating of the combustion chamber by means of a heating plug. In truth, that is only possible with the use of diesel oil and not alcohol, because the physical-chemical characteristics of alcohol prevent such procedure. Diesel oil, for example, has a spontaneous ignition temperature of 250° C., temperature well below the alcohol.

Thus, it has been observed that the most efficient solution is that which heats the fuel at the end of the fuel supply line, site where the fuel rail and the injection valve are found, next to the inlet of the engine cylinder. This heating, at the end of the supply line prevents the cooling of the fuel in the path through the fuel line with respective loss of efficiency of the system.

One of those solutions is the preheating of the fuel, preferably alcohol, in the inner part of the fuel rail of the internal combustion engine. As shown in U.S. document H 1,820, the heating may be performed with the introduction of heating plugs in the rail, in such a way that they heat the fuel before the start of the engine. One drawback of this solution is the cost of having a heating controller through a temperature sensor inside the fuel rail. Furthermore, due to the fact that the heating elements have to heat all the fuel present at the rail, the heating takes up a significantly long time, so that the user must wait a relatively long time for the fuel to be heated.

Normally, the user does not wait long enough for the fuel to be adequately heated, in such a way that is necessary to obtain a satisfactory start and that has reduction in the emissions of pollutants, mainly HC.

It is found, thus, that the volume of fuel contained in the rail is relatively high for the power generated by the heating elements. A simple solution would be the increase of the amount of these elements, or the power thereof, but that would significantly increase the production cost of the fuel heating assembly in the rail. And it would still require a higher capacity of the power source, that is, the battery.

Therefore, a simple reduction in the fuel volume in the rail has been proposed, what at first would be a low cost solution and of easy technical application, but at relatively low temperatures, such proposal does not work in the required way.

In this case a minimal internal volume of fuel in a rail is not present. This minimal volume is a requirement from manufactures of internal combustion engines and of the components thereof, once a minimal amount of fuel must be assured before the fuel line is pressurized. This amount assures the fuel demand at start and at the first instants of operation of the internal combustion engine.

In order to minimize the amount of fuel to be heated in the fuel rail it is proposed in document WO 2005/024225 that heating elements are inside an injection line that comes from a main tube of the rail, i.e. the rail per see. In this injection line the heating element transfers heat to the fuel when the fuel flows from the rail and is passing trough the injection line in direction to an injection valve; thus, not all the amount of fuel that is in the fuel rail must be heated for providing heated fuel to the injection valve.

However, although fuel is heated, non-heated fuel also is provided to the injection valve due to the fact that it cannot be guaranteed that only properly heated fuel is close to the injection valve and will be there provided to the engine. The fuel rail of WO 2005/024225 when mounted in an internal combustion engine has its injection valves located in a lower portion of the engine if compared to the region where the fuel is heated. Thus, a considerable amount of heated fuel tends to rise opposite to the injection valve entrance and cold fuel tends to come closer to the injection valve entrance. In this way cold fuel is provided to the engine when starting it in cold days, thus not allowing a satisfactory start-up of the engine.

Another proposal was the introduction of heating elements inside the body of injection valves, which initially heated the dead volume of fuel contained in the injection valves. It happens that this volume is significantly reduced in such a way that during the start the utilization of fuel present in the rail is necessary. Thus, fuel at a lower temperature is used during the start, in such a way as to present the aforementioned drawbacks. Furthermore, the heating elements present inside the body of the injection valves are, due to the size restrictions thereof, unable to transmit enough heat during the start of the engine. Such solution, besides not heating the fuel in a desired way, also has a high cost.

BRIEF DESCRIPTION OF THE INVENTION

The present invention refers to a fuel-heating assembly used in an internal combustion engine. This assembly has a fuel rail which is provided with a plurality of fuel injection valves, which provide fuel to the engine, the fuel being properly pre-heated before the injection thereof.

This adequate fuel pre-heating is possible due to the fact that an exact amount of fuel is heated in a pre-heating region at the fuel rail.

A method for fuel pre-heating is also disclosed in the present invention. The method proposes the pre-heating of fuel without a conscious intervention of the user, thus optimizing the necessary pre-heating time.

BRIEF DESCRIPTION OF DRAWINGS

The present invention will be, as follows, described in more detail based on an embodiment represented in the drawings. The figures show.

DETAILED DESCRIPTION OF DRAWINGS

As it will be further described, the present invention solves the problems presented in the state of the art by means of a fuel-heating assembly.

The assembly has an arrangement and devices which allow the cold start of an internal combustion engine using a fuel with high specific heat of vaporization without the need of an additional reservoir of starting fuel. Furthermore, it also allows lower emissions of hydrocarbons and pollutants during cold start and operation of the engine.

The assembly for heating of this invention is shown inside a fuel rail, the devices thereof being fixed onto the fuel rail in such a way as to allow the desired fuel heating for the start of the engine, a sufficient temperature being reached for the burning of the fuel in the combustion chamber of the engine.

As disclosed in the state of the art, it is not viable to heat all the fuel present at the rail, and the simple heating of the fuel contained in the injection valve is not enough for the adequate start of the internal combustion engine. Therefore, there is and adequate volume of fuel that must be heated in the rail.

This adequate volume, as mentioned, is greater than the volume contained in the inner part of the injection valve and smaller that all the volume contained in the inner part of the rail. Thus, in case the volume of heated fuel is lower than the adequate volume, after the start the engine cannot keep up and does not operate in the correct way.

On the other hand, if the volume of heated fuel is greater than the adequate volume, a very long pre-heating time is necessary, which is not desired by the user. In this second case, if the engine is actuated with a short pre-heating time, the fuel temperature is not high enough for the adequate operation of the engine, that is, it would not start, or even, if that happened, the emissions would be too high.

Therefore, in such a way as to comply with all the requirements above, the present invention provides the heating of an ideal volume of fuel from heating elements and other devices of the assembly.

Figure 1:
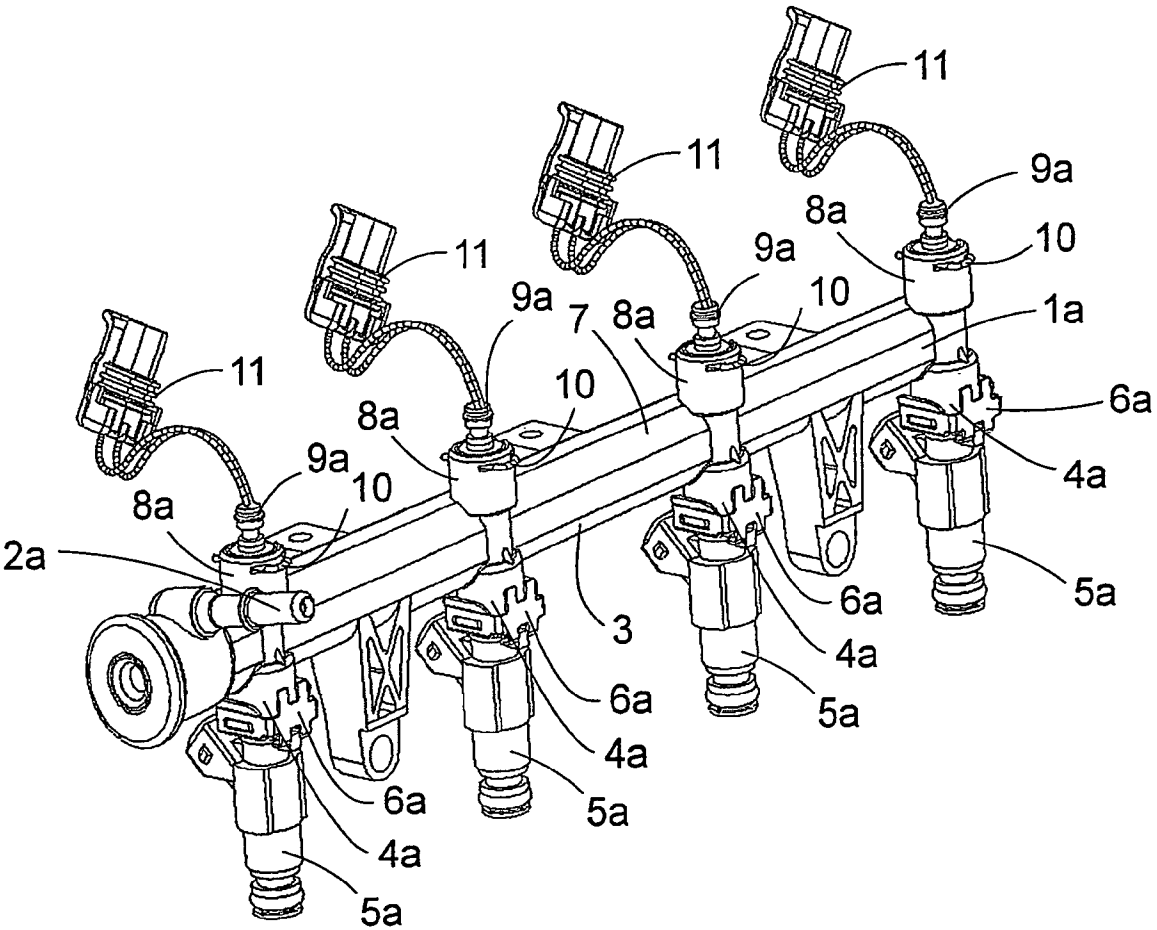
FIG. 1 it is perspective view of a fuel-heating assembly applied to a fuel rail.

As it can be seen from FIG. 1, a fuel rail 1*a* has a fuel inlet 2*a*. From this fuel inlet 2 fuel is provided from a pressurization system, which is not disclosed in the figures. The pressurization system consists basically of a fuel pump that pressurizes fuel in a piping which is connected to the fuel inlet 2, which, by its turn, keeps the inner part of the rail 1 pressurized with fuel.

At a lower face 3 of the rail 1*a* there are fuel outlets 4*a*. At each outlet 4*a* there is connected a respective injection valve 5*a*, which atomizes the fuel before it is burnt in a combustion chamber of an internal combustion engine.

The injection valves 5*a* are connected to the rail 1*a* by means of retention elements 6 which are, preferably, clamps 6*a*. These clamps 6*a* keep the injection valves fixed to the rail in a tight way, preventing thus the exit of pressurized fuel at the junction of the injection valve 5*a* with the fuel outlet 4*a*.

Opposed to the lower face 3 there is an upper face 7, which contains reception openings 8*a* of heating elements 9*a*. The openings 8*a* allow that each heating element 9*a* enters the rail 1*a* and heats the fuel contained therein (the heating will be further explained).

Between heating elements 9*a* and openings 8*a* there are retention lugs 10 that perform the fixation and by means of this fixation, together with a sealing element (not shown in FIG. 1), prevents the exit of fuel through the openings 8*a*.

To the heating elements 9*a* there are linked connectors 11, which are responsible for the supply of electric power coming from a battery to the heating elements 9*a*. The electric power is transformed into thermal energy and transferred to the fuel at the inner part of the rail 1 through the heating elements 9*a*.

Figure 2:
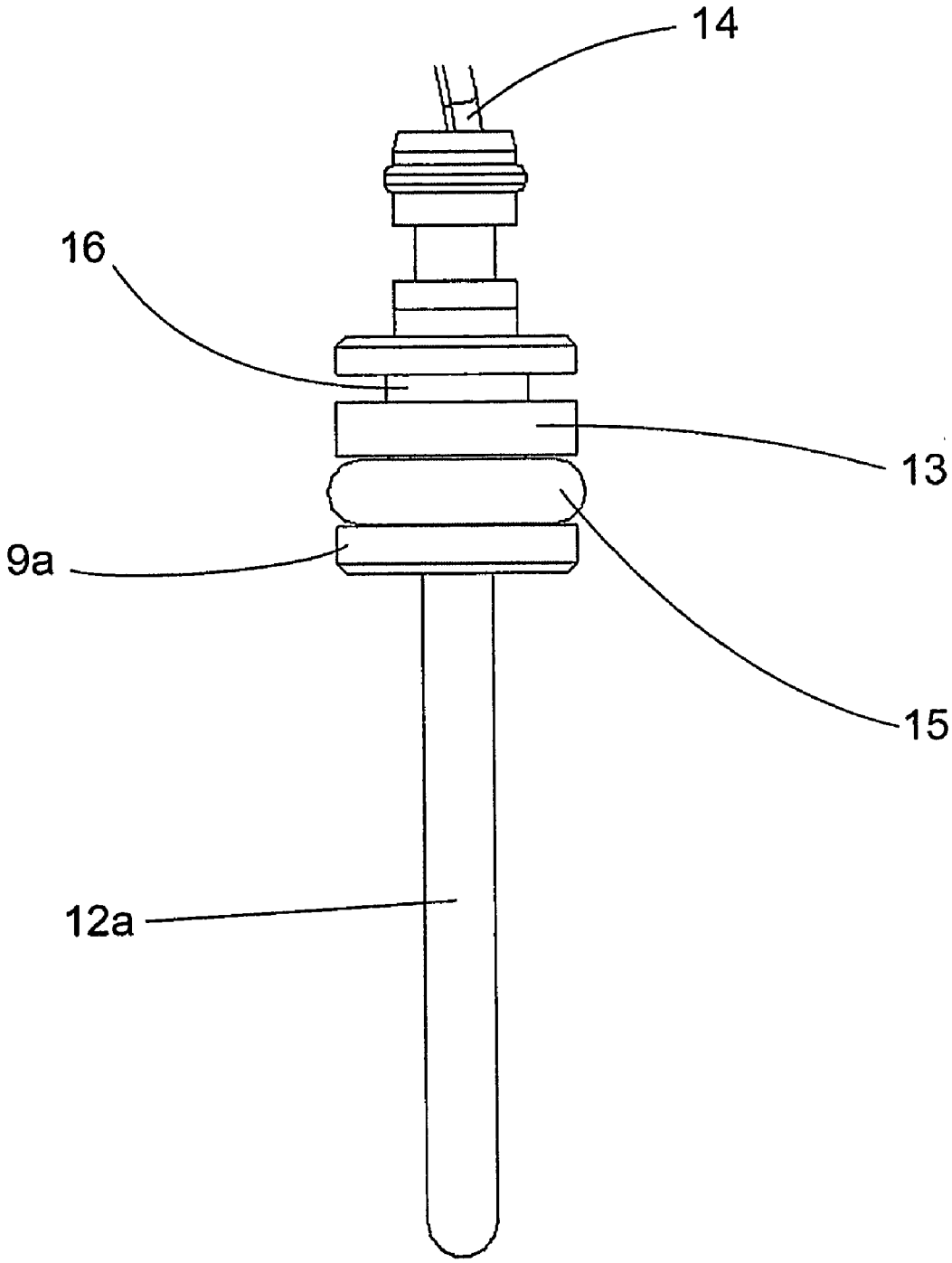
FIG. 2 is a front view of a heating element used in the a fuel-heating assembly.

From FIG. 2 the isolated heating element 9*a* can be seen, that is, not mounted onto the borehole 8*a* of the fuel rail 1. The heating element 9*a* is similar to a heating element of the state of the art, but concentrates its heat distribution in a different way, as will be further explained.

The heating element 9*a* has at one of its ends a lance 12*a* which is responsible for the heat transfer to the fuel to be heated in the inner part of rail 1*a*. This lance 12*a* is composed by an outer layer that is hot-gas and corrosion resistant. It is hot-gas resistant, once that at the inner part thereof there is a filament that transforms electric power into thermal energy, homogenously, to a compressed magnesium oxide powder. It is corrosion resistant, once that it is in direct contact with fuel, what may be highly corrosive, such as alcohol.

At a central portion of the heating element 9*a* a central body 13, which is responsible for the engaging of the heating element 9*a* to the borehole 8*a* of the rail 1*a*, there is a sealing ring 15 that performs the sealing and prevents the leaking of fuel from the rail 1*a* through the borehole 8*a*.

At the other end of the heating element 9 there is fixed a cable 14 that by its turn is linked to the connector 11, responsible for the electric power supply. In ring-like groove 16 the clamps 10 are connected in such a way as to keep the heating element 9*a* fixed to the rail 1.

Figure 3:
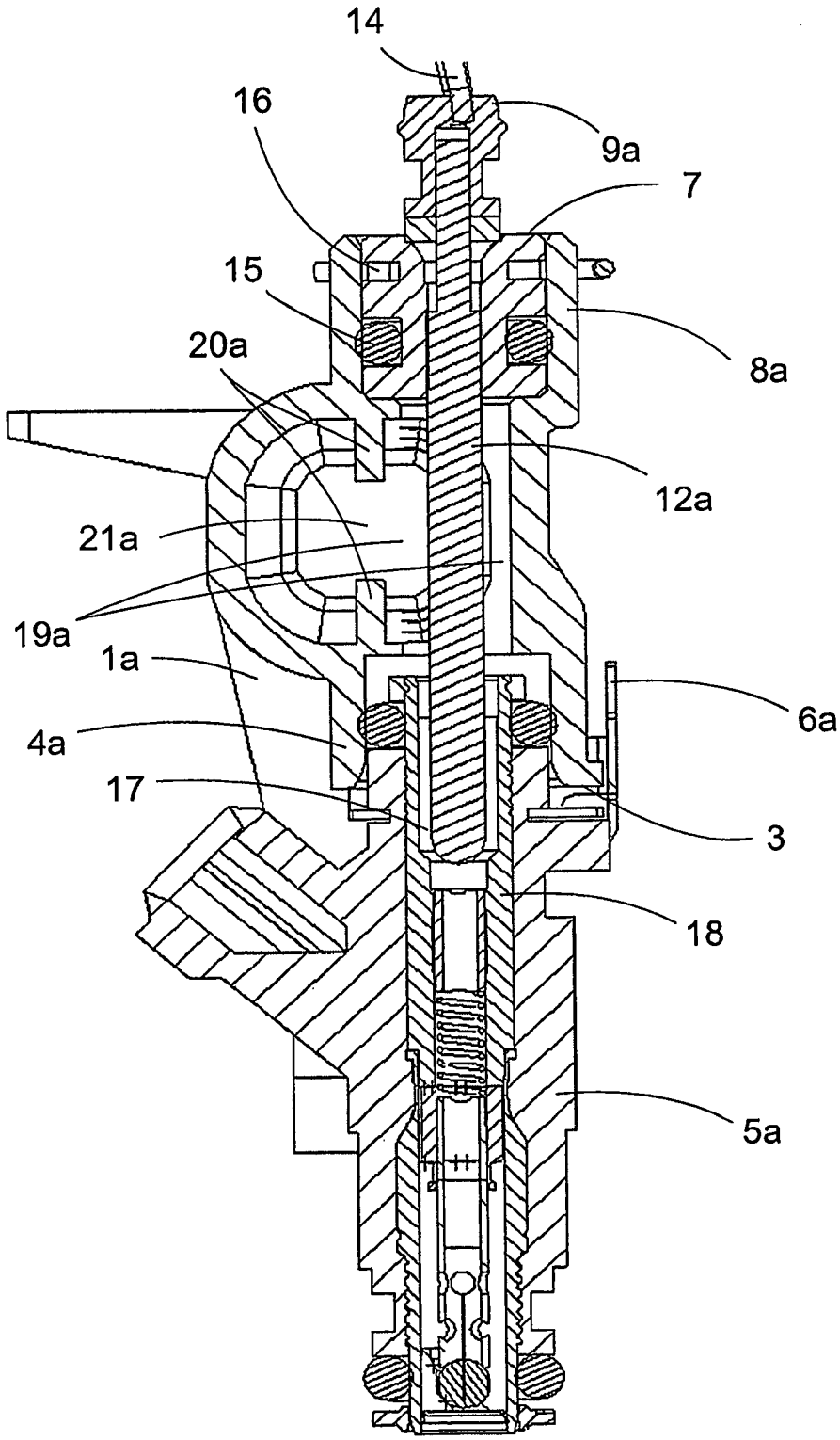
FIG. 3 is a sectional view of a first embodiment of the invention of the a fuel-heating assembly.
Figure 4:
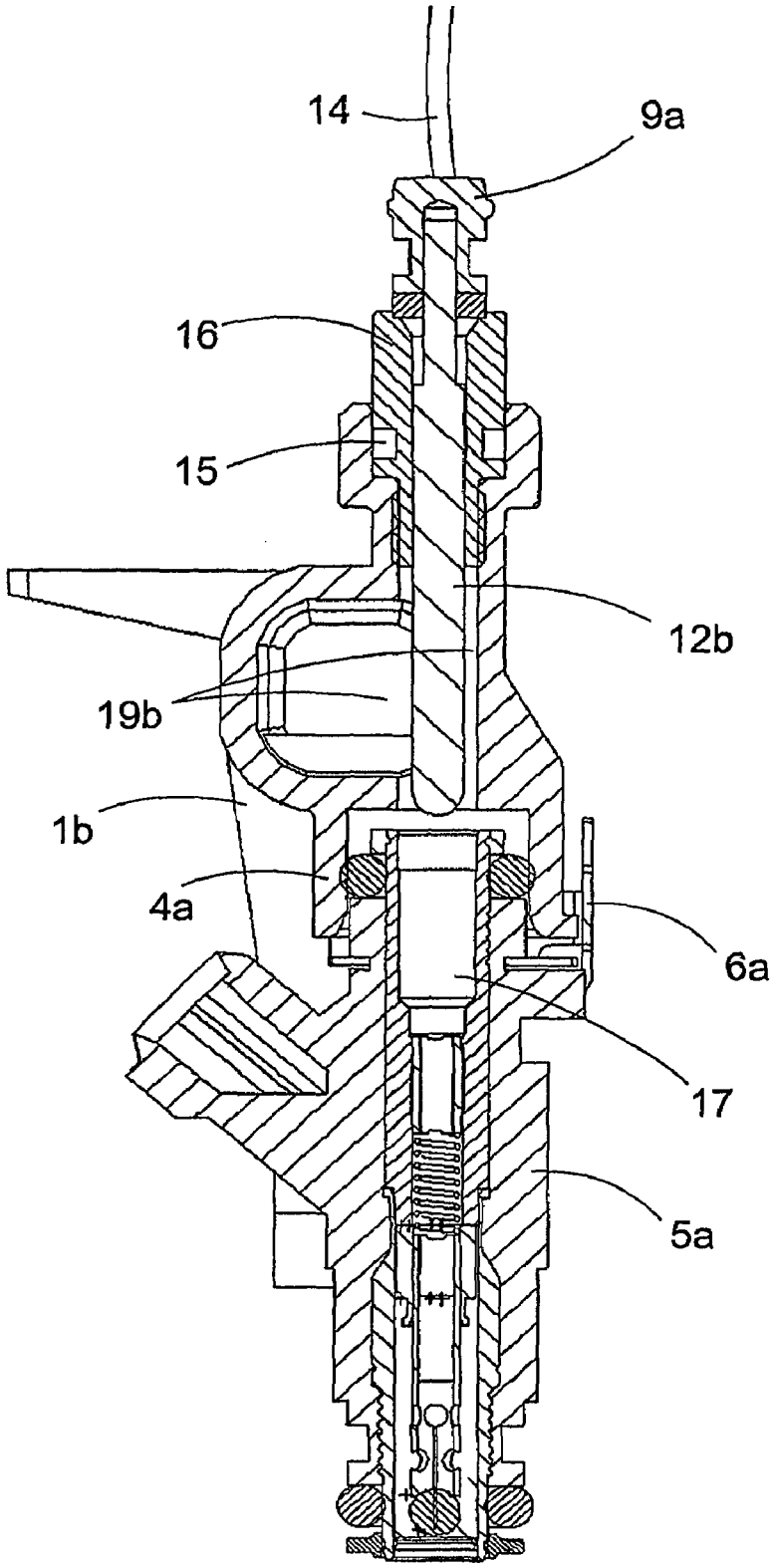
FIG. 4 is a sectional view of a second embodiment of the a fuel-heating assembly.

By means of FIGS. 3 and 4 two possible first embodiments of the present invention can be verified. These figures are cross-sectional views of the present assembly, but have some differences that will be discussed herein below.

The first embodiment of the invention, seen in FIG. 3, is a cross-sectional view of the rail 1*a* in which the sections of the injection valves 5*a* and of the heating element 9*a* are shown.

The injection valve 5*a* does not show any significant change when compared to a valve of the state of the art. The most significant difference is that it does not show a filter at the fuel inlet 17, or show a modified filter between a lance 12*a* and an inner wall 18 of inlet 17.

This filter is not disclosed in FIG. 3, but consists basically of a filter of the state of the art with an internal borehole, being resistant to high temperatures, as it is in direct contact with the lance 12*a*.

When this filter is not present in the fuel inlet 17, another filter can optionally be mounted in the fuel opening 2*a* of the rail 1*a*.

It can be seen that, at the lower face 3 of rail 1*a* the injection valve 5*a* is engaged to the fuel outlet 4*a*. Thus, when an internal combustion engine is in operation, the rail la supplies heated fuel for the respective atomization in injection valve 5*a*.

Opposed to the injection valve 5*a*, the heating element 9*a* is found at the upper face 7 and is engaged to the opening 8*a* of the rail 1*a*. It is worthwhile to stress, as mentioned before, that the heating element is fixed by the clamp 16 and sealed by the sealing ring 15 to the opening 8*a*.

The lance 12*a* is inserted in the inner part of the rail 1*a* where the fuel to be is heated is, being positioned in such a way at the rail 1*a* that it concentrates in a heat transfer region 19*a* part of the fuel of the rail around it. In other words, only part of the fuel that is present in the rail 1 is able to receive heat coming from the lance 12*a*. That is due to the fact that it is aimed only the heating of part of the fuel of the rail in such a way that it can be assured that the fuel which will enter the injection valve 5*a* is properly heated. That is because necessarily the fuel which will enter the injection valve 5*a* will have to have passed through the heat transfer region 19*a*.

Thus, with this concentration of heat transfer of part of the fuel from rail 1*a*, the lance 12*a* is able to have enough power to assure an injection of properly heated fuel to an internal combustion engine, which is one of the aims of the present invention.

Additionally, fins 20*a* are positioned next to the lance 12*a* in such a way as to restrict the flow of all fuel from the rail 1*a* to the heat transfer region 19*a*. That increases the required concentration. Therefore, it is thus assured that the fuel will be suitably heated.

The fins 20*a* run along the extension of the inner part of the rail la and have a passage 21*a* between the heat transfer region 19*a* e the remaining of the inner part of rail 1. That allows the volume of fuel present in region 19*a* to be adequate to be heated during the start of an internal combustion engine. It is noted that the position of fins 20*a* does not depend on the operation of said assembly, in such a way that the former can show other geometries, such as, for example, instead of fins 20*a*, it is possible to use an inner wall with holes. Later there will be described other embodiments of the fins of the set, object of this invention, being that the essential is that the flow is restricted to the heating region 19*a*.

It must be noted that in the present embodiment, by the fact that the extension of the lance 12*a*, the heat exchange area is larger than in the second embodiment, which will be further shown. However, it is necessary for the opening 8*a* to have a reference diameter to pre-position the lance 12*a* aiming at assuring it to be concentric in relation to the fuel inlet 17.

This reference diameter has a hole with controlled dimension so that, during the mounting of the assembly, the lance 12*a* is with interference, allowing thus a fixation without clearance.

It must be further noted that with the insertion of lance 12*a* at the inlet of fuel 17, the heat transfer region 19*a* is significantly increased.

Now, from FIG. 4 the second embodiment of the invention can be observed. In this embodiment the difference is present in a lance 12*b* in relation to the first embodiment that has a lance 12*a* with a greater length. Once the lance 12*b* has a smaller length than lance 12*a* it consequently transfers less heat to the fuel in one heat transfer region 19*b*. Still, due to this smaller length, one of the ends of the lance 12*b* faces the fuel inlet 17, and therefore it is not necessarily concentric to this inlet. Thus, it does not require so precise a connection if compared to the first embodiment, thus making the mounting of the assembly easier and reducing the production costs of the present assembly.

Likewise, by the fact that the lance 12*b* does not enter the injection valve 5 the filter can be kept inside said valve, differently from the first embodiment.

In this FIG. 4 the fins 20*a* are not disclosed. However, the fins 20 may be present or not in both embodiments in such a way as to restrict the passage of non-heated fuel to the heat transfer region 19*a*, 19*b*.

The main difference in heating in both first embodiments is that in the first the pre-heating time is shorter than in the second, once due to the greater area of the lance 12*a*, it has the possibility of transferring more heat. But in both cases the fuel inside the rail 1, provided to the injection valve 5 is heated in the required way.

From the other embodiments of the present invention, with the exception of the first one, only the main alterations of the embodiments will be pointed out, so that one should understand that, in the first embodiment, one has already pointed out how the heating assembly components interact.

Figure 5:
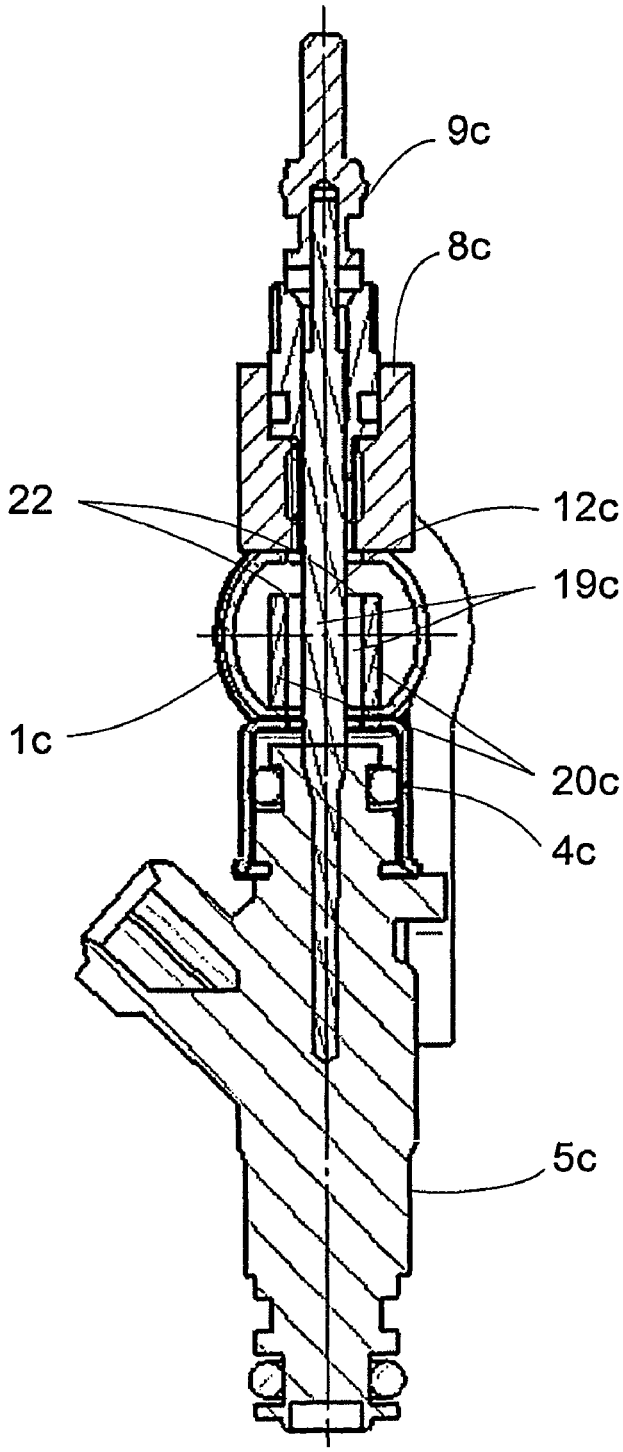
FIG. 5 is a sectional view of a third embodiment of the fuel heating assembly of the invention.

In order to exemplify another possible embodiment of the lugs 20*a*, one can observe in FIG. 5 that a rail 1*c* has a different internal configuration. Although this cross-sectional view of the assembly of the present invention has fewer details than the assemblies demonstrated before (the later embodiments also have fewer details), one can see a spear 12*c* of a heating element 9*c* in the rail 1*c* in the direction of an injection valve 5*c*.

In this rail the fuel flow is restricted by means of flaps 20*c*, which enclose a portion of the spear 12*c* that is inserted into the rail 1*c*. The flaps 20*c* follow the axial direction of the spear 12*c*, so that a passage 22 permits a restricted fuel flow into a heat transfer region 19*c*, which in the present embodiment is the space formed between the flaps 20*c* and the spear 12*c*. In addition, in order for the fuel to have, along its path, greater contact with the spear 12*c*, the flaps 20*c* are fixed within the rail closer to the injection valve 5*c*, opposed to the opening 8*c*.

Since there is a concentration of fuel flow in the heat transfer region 19*c*, there is the guarantee of sufficient heating for a significant amount of fuel to be injected by the injection valve 5*c*, without the need to heat the whole volume of fuel contained in the rail 1*c*.

In addition, the heat convection of the fuel that is being heated close to the spear 12*c* allows the fuel with a higher temperature inside the rail to concentrate closer to the passageway 22. This occurs because the fuel with a higher temperature tends to concentrate in a higher portion of the rail 1*c*.

Thus, upon starting the internal combustion engine, it is guaranteed that the first portions of fuel that pass through the injection valve 5*c* will be those that are at a higher temperature.

As mentioned before, the flaps 20*c* may be of different shapes, but the important thing is that they should increase and retain the concentration of heat in the heating region 19*a*, 19*c*.

In this last embodiment, there is a need for the spear 12*c* to be concentric to the injection valve 5*c*. However, there is the possibility of not using the spear concentrically to the injection valve 5*c*.

Figure 6:
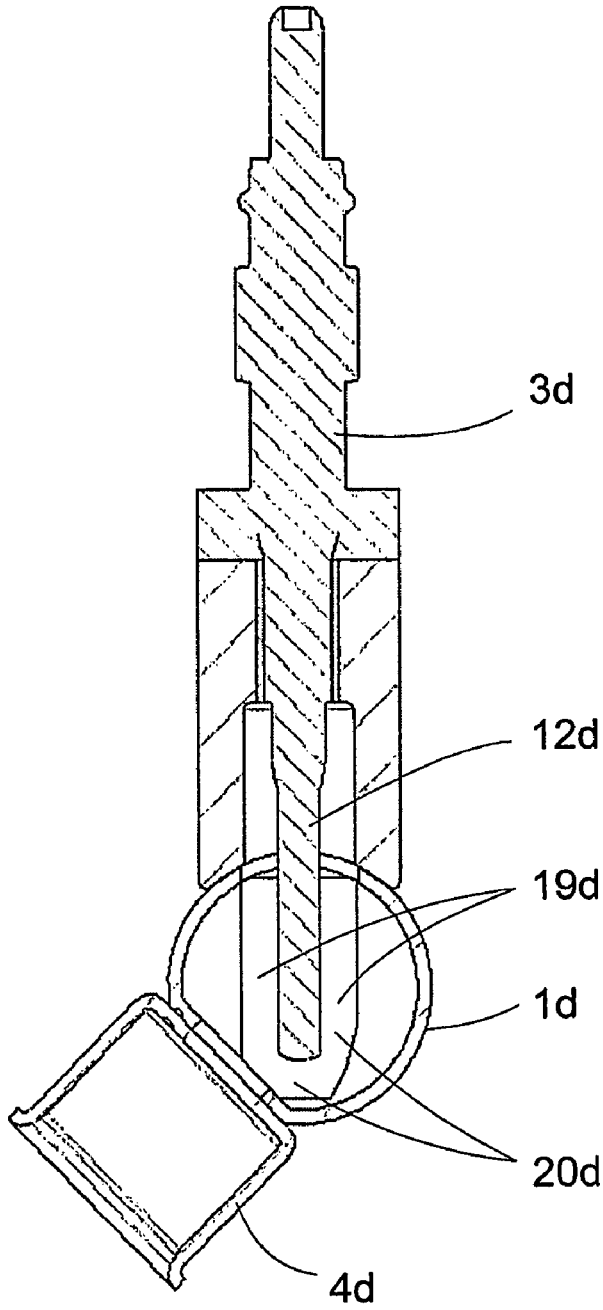
FIG. 6 is a sectional view of a fourth embodiment of the fuel heating assembly of the invention.

The non-concentricity may be viewed in the embodiment represented in FIG. 6, in which the spear 124 is inserted into a fuel rail 1*d*, so that, unlike the other embodiments, does not pass through the rail 1*d*. This occurs in view of the displacement of an injection valve. In this case, the injection valve has not been shown; only a fuel outlet 4*d*.

It is verified that this fuel outlet 4*d* is displaced with respect to the spear 12*d*. However, enclosing a lower portion of the spear 12*d* flap 20*d*, shaped in U-profile, forms a heating region 19*d*, providing an accumulation of heated fuel close to the fuel outlet 4*d*.

Therefore, when the internal combustion engine is started, the fuel accumulated in the heating region 19*d* is injected and the cold star of the engine is ensured.

Some projects of an internal combustion engine require a smaller fuel-heating assembly, due to the dimensions available in the engine cowling, as well as a lager amount of heated fuel.

Thus, a positioning of the spear 12*a*, 12*b*, 12*c*, 12*d* concentrically to the injection valve 5 is not advisable.

Figure 7:
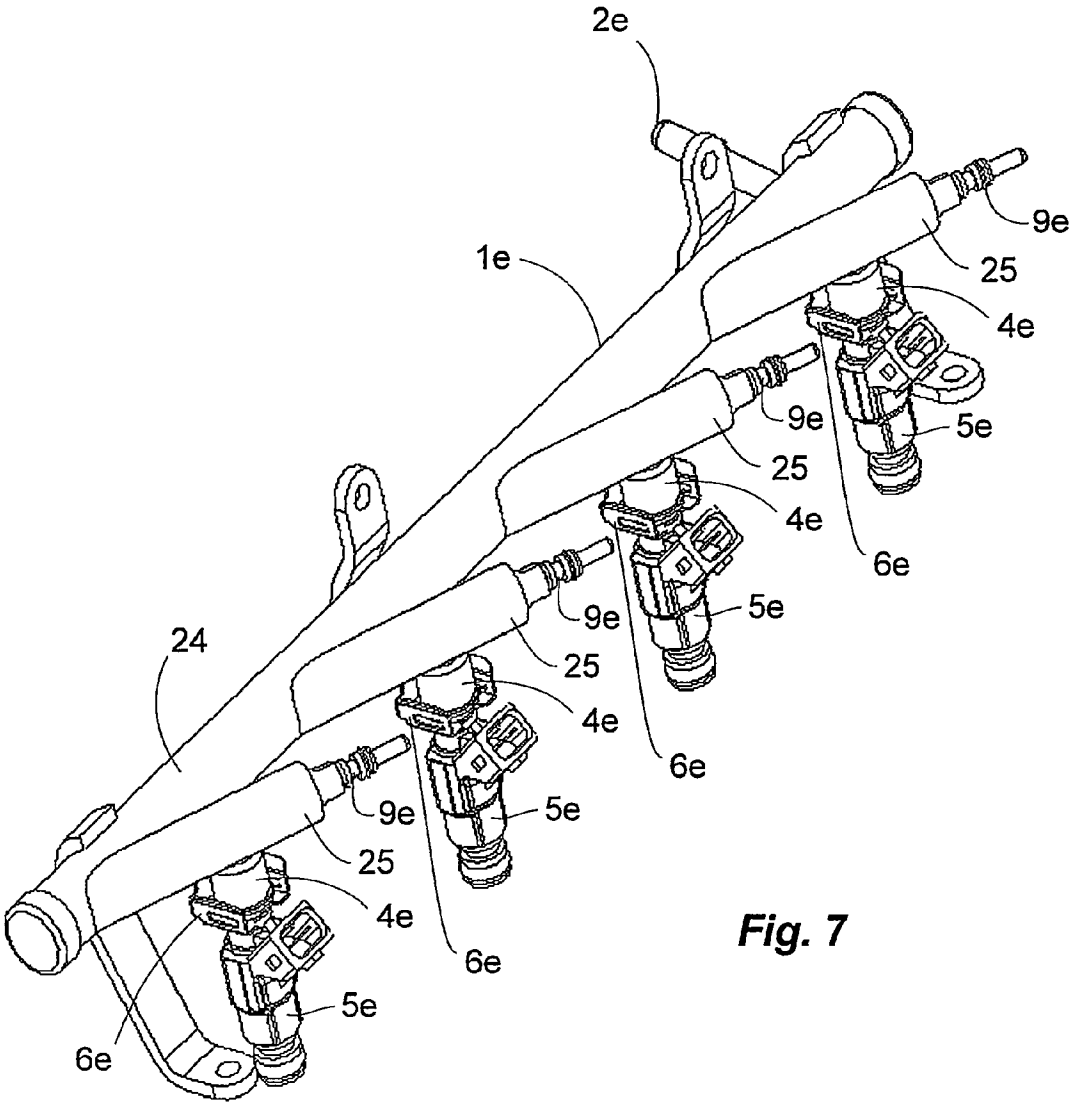
FIG. 7 is a perspective view of a fifth embodiment of the fuel heating assembly of the invention.

From FIG. 7 one can see a rail 1*e*, which consists of a main tube 24 and four secondary tubes 25 having fluid communication with each other. This rail comprises a fuel inlet 2*e*, through which fuel is pumped into the rail 1*e*.

Each secondary tube 25 comprises a fuel outlet 4*e* at its central portion, to which an injection valve 5*e* is connected. This injection valve is kept secured to the secondary tube 25 by means of a clamp 6*e*.

The positioning of the injection valve 5*e* is orthogonal to the axial direction of the secondary tube 25, which in turn has an inclination with respect to the axial direction of the main tube 24.

In the present embodiment, the secondary tubes 25 are parallel, and heating elements 9*e* are inserted at an opposite end between the attachment of the secondary tubes 26 and the main tube 24.

Figure 8:
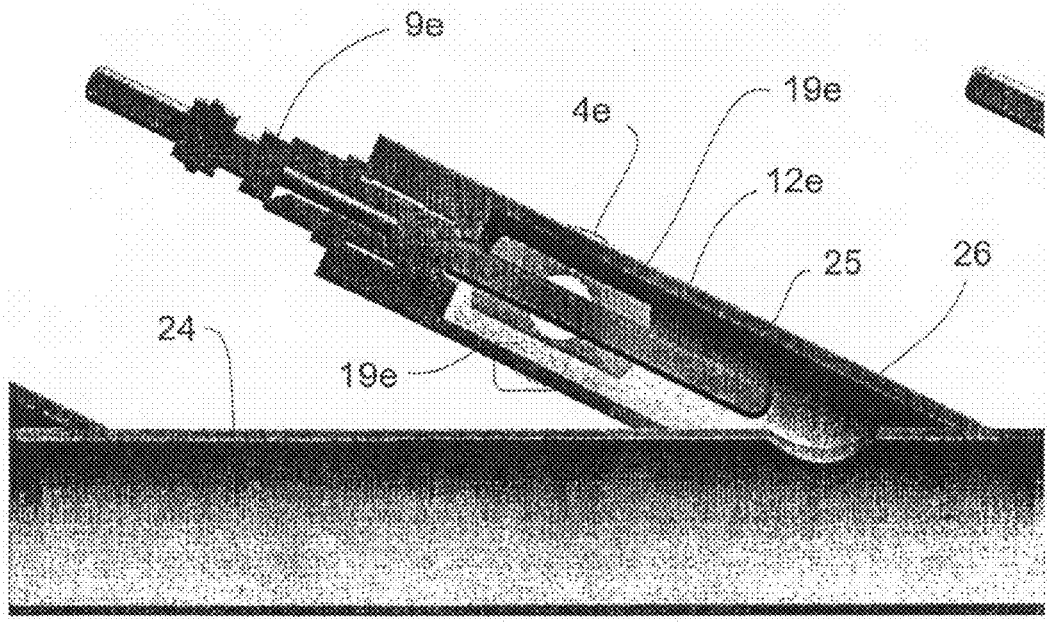
FIG. 8 is a sectional view of fifth embodiment of the fuel heating assembly of the invention.

The internal details of the assembly of the present embodiment can be viewed in FIG. 8, which is a sectional top view showing a part of the main tube 24, of the secondary tube 25 and of the heating element 9*e*.

As can be seen in FIG. 8, the heating element 9*e* has a spear 12*e*, which follows the axial direction of the secondary tube 25, as far as close to a communication orifice 26 between the secondary tube 25 and the main tube 24. It is from the communication orifice 26 that the fuel flows from the main tube 24 to the secondary tube 25, which then flows to the fuel outlet 4*e*, until it is injected into an internal combustion engine through an injection valve that is not represented in the present embodiment.

The fuel flow from the main tube 24 into the secondary tube 25 is restricted by the communication orifice 26. In this way, the heating of the fuel is concentrated inside the secondary tube 25, which configures a heating region 19*e* around the spear 12*e*. Again, it is ensured that the fuel which will be injected into the internal combustion engine is duly heated.

In this embodiment, the secondary tube 25 is in a position slightly higher than the main tube 24. Consequently, due to the fact that the fuel having a higher temperature tends to rise, there is the guarantee that the more heated fuel will be the first to pass through the fuel outlet 4*e* upon starting the internal combustion engine. In addition, there is only a minor loss of heat of the fuel that is being heated in the heating region 19*e* through the communication orifice 26.

Each heating region 19*e* of this embodiment is thermally isolated from another, since the heat supplied to the fuel close to each spear 12*e* does not influence the heat supplied to the other heating regions 19 of the assembly according to the present invention. So, the same quantity of heat transmitted to the fuel that will be injected through each injection valve is ensured. In the other embodiments there was the possibility of the injection valve opposite the fuel inlet into said rails injecting a fuel with a higher temperature than that of the valve close to the fuel inlet.

Figure 9:
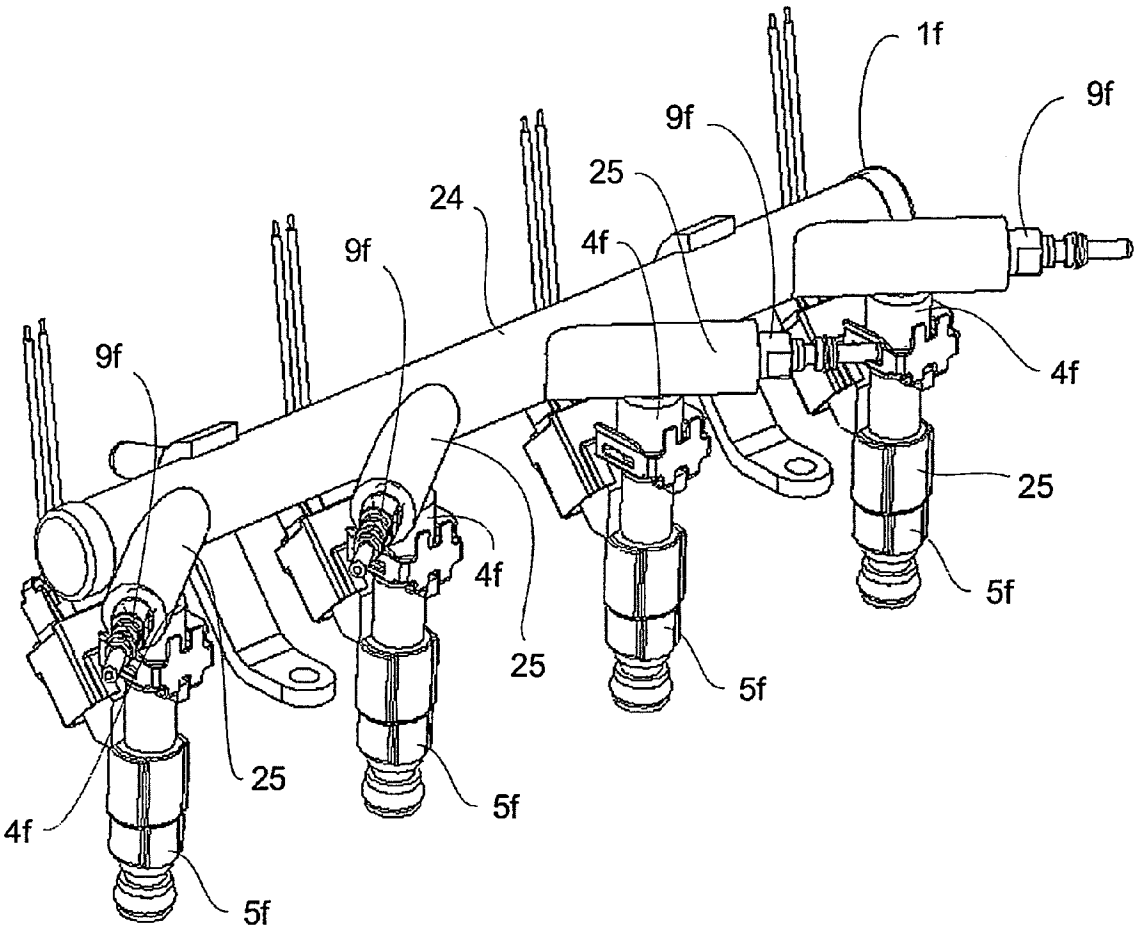
FIG. 9 is a perspective view of a sixth embodiment of the fuel heating assembly of the invention.

The secondary tubes 25 may further present different inclinations, depending upon the type of project of the internal combustion engine. This can be seen in FIG. 9, where two secondary tubes 25 are inclined opposite other two secondary tubes 25. Since this is a fuel heating assembly for another type of internal combustion engine, the dimensions are different, as for example, the spacing between secondary tubes 25 and, consequently, between injection plugs 5*f*.

Heating element 9*f* should also follow the axial direction of each respective secondary tube 25. In this embodiment the electric connections of the injection valves 5*f* face the main tube 24, so that the electrical feeds of the valves 5*f* are located below the rail 1*f*.

Figure 10:
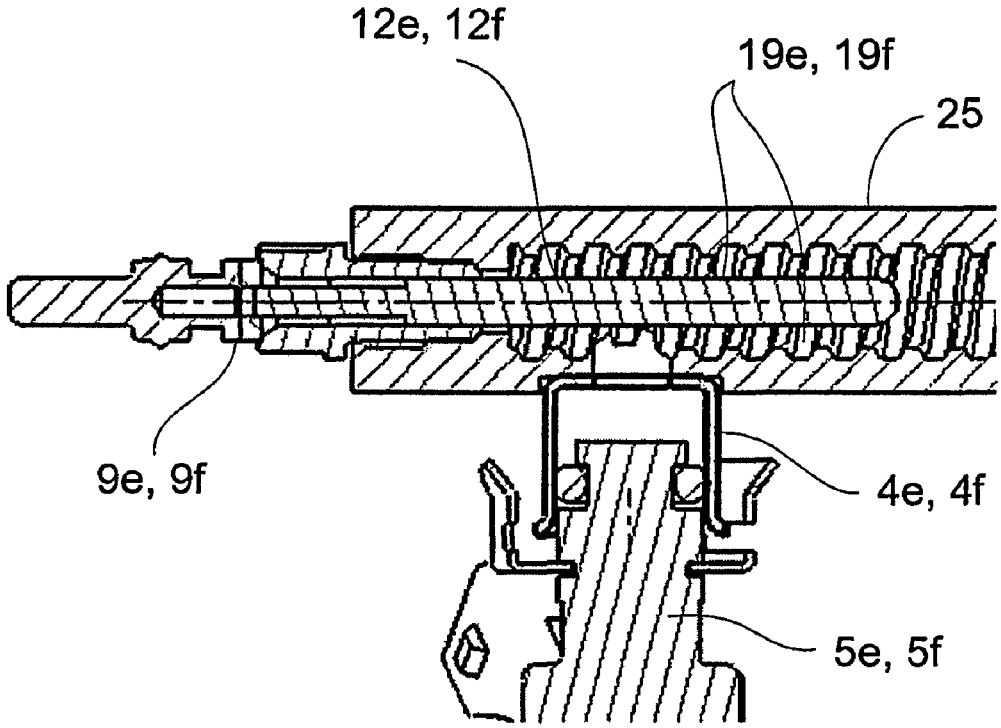
FIG. 10 is a sectional view of a detail of the fuel heating assembly.
Figure 11:
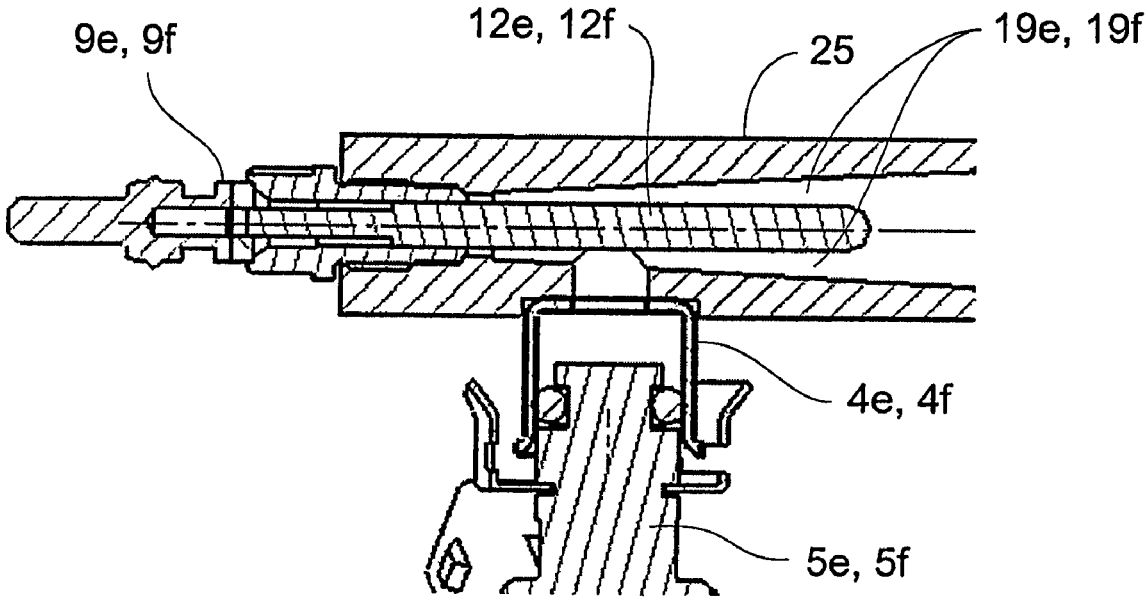
FIG. 11 is a section view of a detail of the fuel heating assembly.

In FIGS. 10 and 11, one can see internal variations of the secondary tube 25, which are intended for reducing speed and concentration of the fuel that passes through the tube.

In FIG. 10, one can see the injection valve 5*e*, 5*f* connected to the fuel outlet 4*e*, 4*f* and the heating element 9*e*, 9*f* attached to the secondary tube 25 with the spear 12*e*, 12*f* introduced into the heating region 19*e*, 19*f*. On the inner wall of the secondary tube 25, a thread has been made, which performs the function of reducing the speed of the fuel, thus enabling a greater heat exchange in the heating region 19*e*, 19*f*.

On the other hand, FIG. 11 shows the injection valve 5*e*, 5*f* connected to the fuel outlet 4*e*, 4*f* and the heating element 9*e*,9*f* attached to the secondary tube 25 with the spear 12*e*, 12*f* introduced in the heating region 19*e*, 19*f*.

The inner wall of the secondary tube 25 has an increase in section downstream of the fuel flow, that is to say, in the direction of flow its flume increases, so that there is a greater concentration of heat exchange close to the fuel outlet 4*e*, 4*f*, in view of the smaller volume of fuel to be heated.

Figure 12:
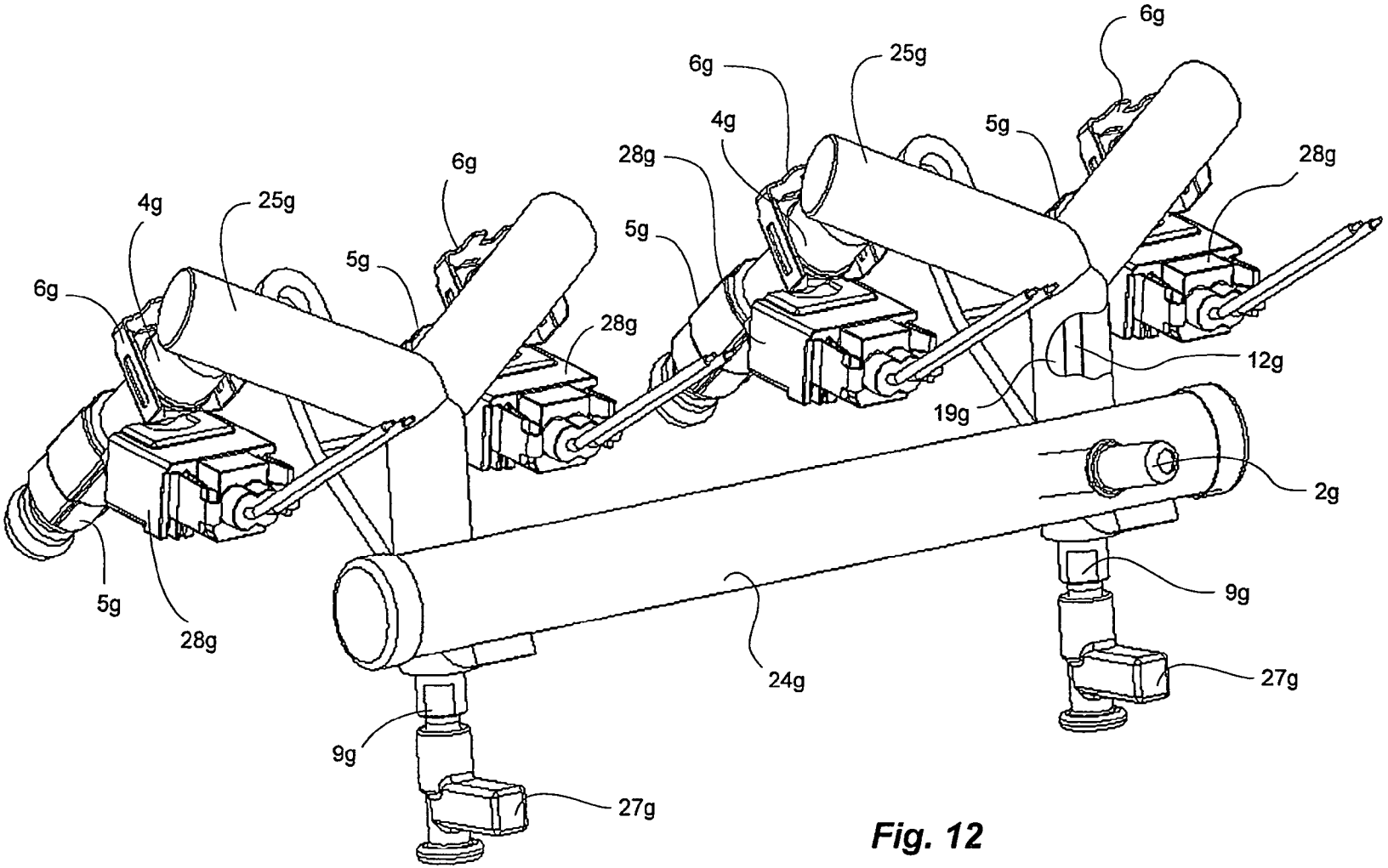
FIG. 12 is a perspective view of a heating assembly.

Furthermore, as can be seen in FIG. 12, a main tube 24*g* has a fuel inlet 2*g*, which is in communication with a fuel pressurization system. The main tube 24*g*, an integral part of a fuel rail, which is also formed by two secondary tubes 25*g*, has communication with said secondary tubes 25*g*.

Therefore, fuel can enter through the fuel inlet 2*g*, pass through the main tube 24*g*, then through the secondary tubes 25*g*, until it reaches the injection valves 5*g*.

The main tube 24*g* is elongate in shape, the Y-shaped secondary tubes 25*g* being connected substantially at its ends.

The manner in which the fuel gets into the secondary tube 25*g* will be demonstrated later, but one can see in this figure that the secondary tube 25*g*, due to its shape, has three ends, the first and second ends being attached to injection valves 5*g*, that is to say, a par of injection valve 5*g* being connected to each secondary tube. This connection is carried out by means of a fuel outlet 4*g*, the injection valve 5*g* being retained in said outlet by means of a clamp 6*g*.

On the other hand, the third end of the secondary tube 25*g* is connected both to the main tube 24*g* and to a heating element 9*g*.

As already demonstrated in one of the previously demonstrated heating assemblies, the heating element 9*g* has a lance 12*g* that gets into the secondary tube 25*g* close to the connection between the main tube 24*g* and the secondary tube 25*g*.

In addition, in the present embodiment some other accessories of the present heating assembly are employed, namely, a connector 27*g*, which is responsible for the power supply connection to the heating element 9*g*. Another accessory is the connector 28*g*, usually employed in the automotive industry, which supplies an electric stimulus/pulse for the functioning of the injection valve 5*g*.

Figure 13:
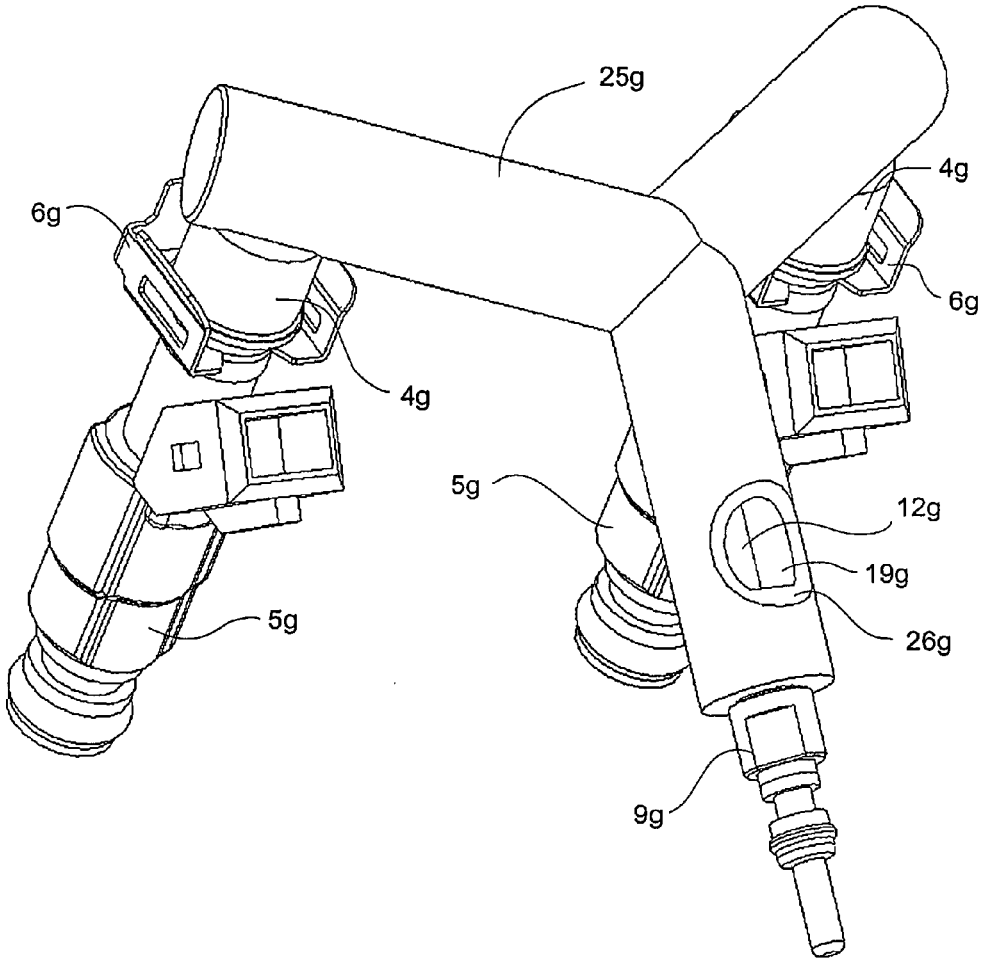
FIG. 13 is a perspective view of a detail of the heating assembly of FIG. 12.

FIG. 13 represents a part of the heating assembly of FIG. 1, in which the secondary tube 25*g* has been highlighted. One can see that only one of the secondary tubes 25*g* and the respective pieces of equipment connected to it are represented, as for instance, the injection valves 5*g*, the fuel outlets 4*g* and the claims 6*g*.

One can further see that, at the end of the secondary tube 25*g*, in which the heating element 9*g* is inserted, that there is a communication bore 26*g*, which accounts for the passage of fuel from the main tube 24*g* into the secondary tube 25*g*. This bore is nothing else than the intersection between the two tubes.

The fuel that enters into the secondary tube 25*g* comes into contact with the lance 12*g* present inside said tube when it passes through the communication bore 26*g*. In this regard, during the heating, there is transfer of heat between the lance 12*g* and the fuel in contact with or close to said lance. In this way it is guaranteed that the fuel that comes out of the main tube 24*g* necessarily passes through a heat-transfer region 19*g*, which is formed by the confinement of the fuel that is substantially within the secondary tube 25*g*.

The lance 12*g* extends to the central portion of the secondary tube 25*g* and, when the fuel is divided upon flowing towards the injection valves 5*g*, it does not receive heat from the lance 12*g* any longer. However, this lance might eventually have other shapes, in order to extend in direction of the fuel outlets 4*g*. Therefore, the heating element 9*g*, more precisely the lance 12*g*, is substantially close to the fuel outlet 4*g*.

Thus, it is found that a volume smaller than the total volume of the rail is heated, which enables duly heated fuel to be supplied to the injection valves 5*g*, or still naturally to an internal combustion engine, which is the ultimate objective of the invention.

It should be further pointed out that, as mentioned in one of the previous heating assemblies, there is a certain loss of heat through the communication bore 26*g*, but it is not significant enough to impair the heating of the fuel that will follow for injection.

Figure 14:
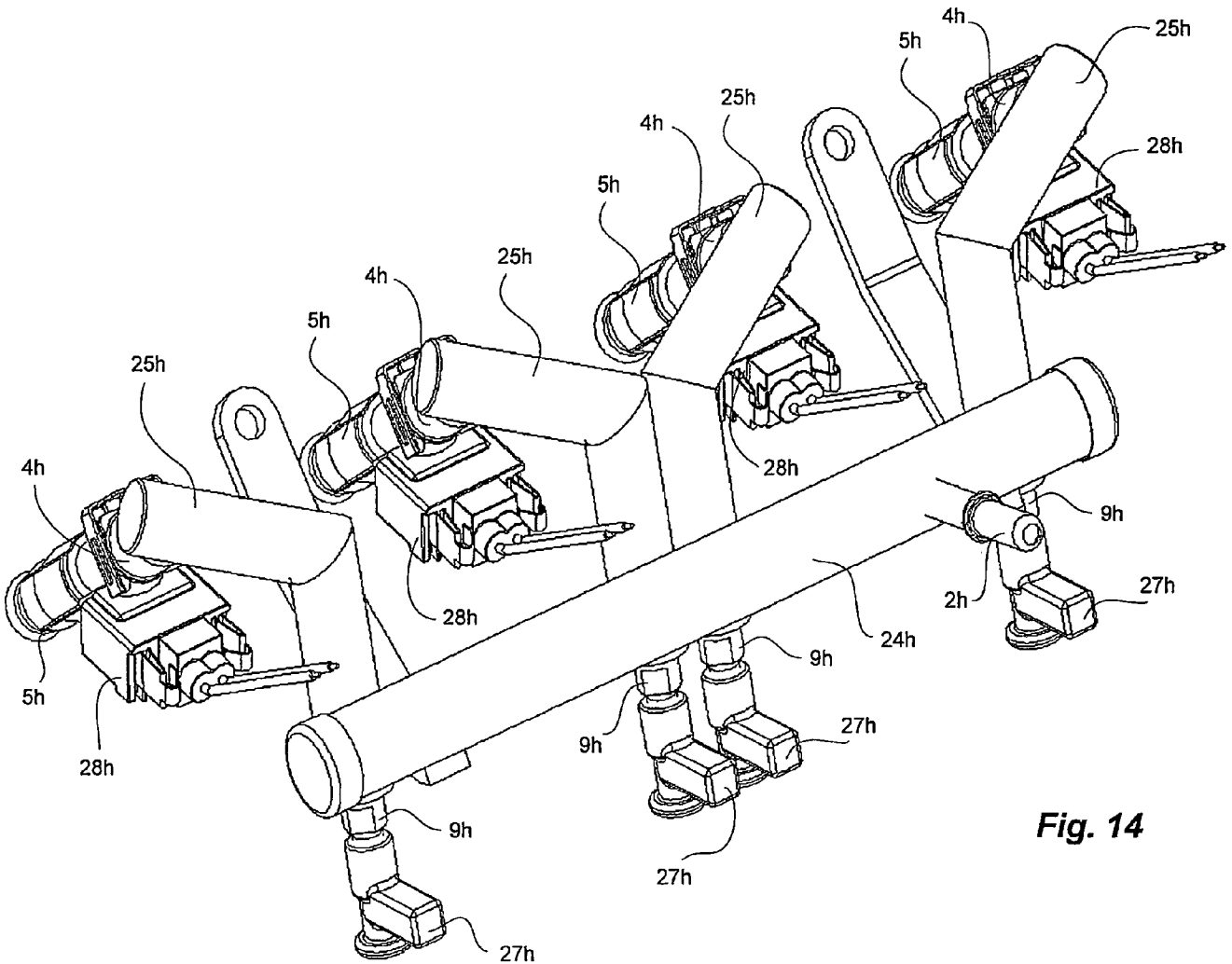
FIG. 14 is a perspective view of a heating assembly.

Another variant of the present invention can be seen in FIG. 14. This variant is similar to the previous one, since it has connectors 27*h*, 28*h*, injection valves 5*h*, main tube 24*h*, fuel inlet 2*h*, which perform functions similar to those of the connectors 27*g*, 28*g*, injection valves 5*g*, main tube 24*g*, fuel inlet 2*g* of the previous embodiment.

However, this variant, if compared with the previous one, has a larger number of heating elements 9*h*, so that each element accounts for heating the fuel that will pass through an injection valve 5*h*.

Figure 15:
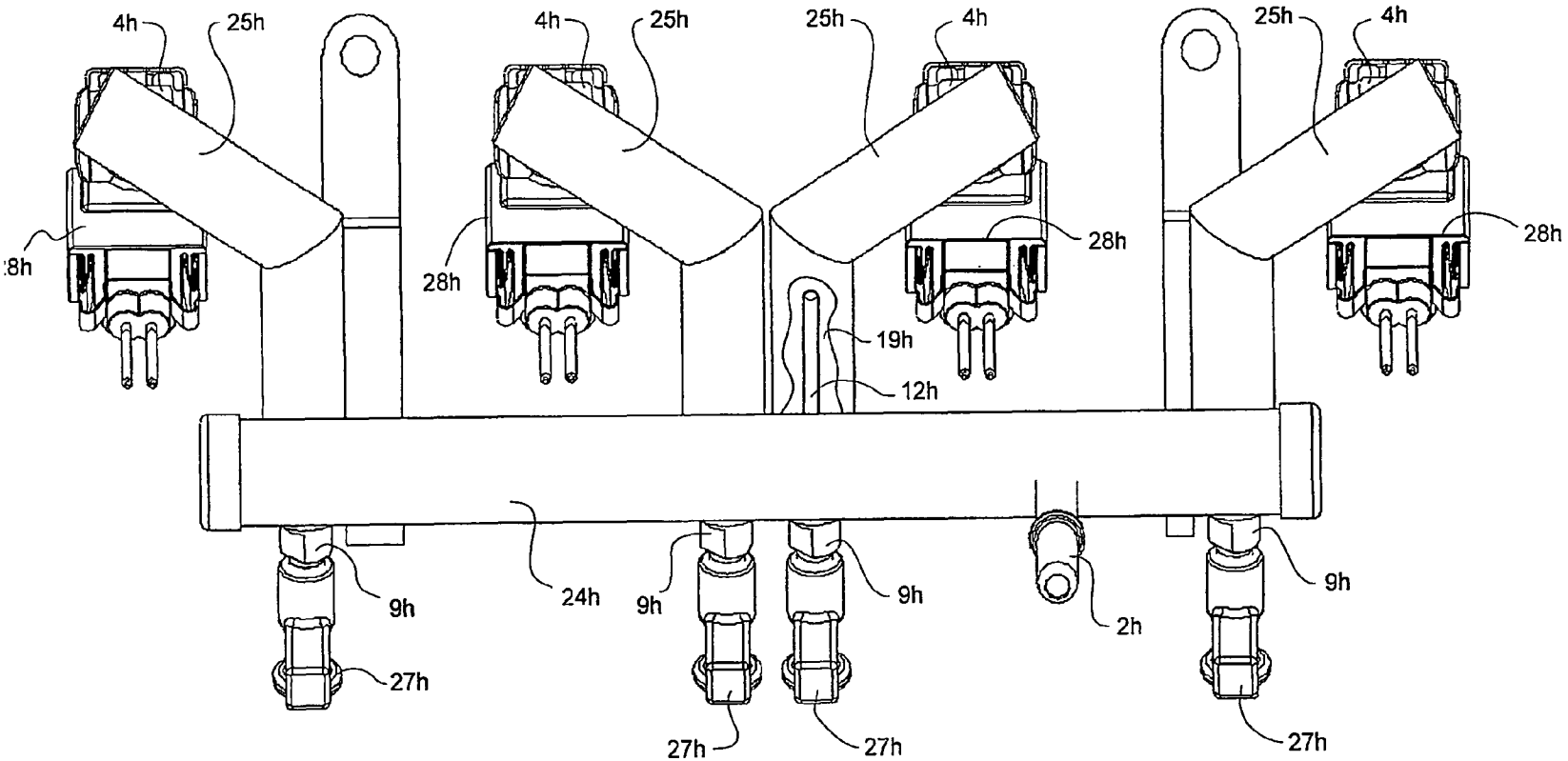
FIG. 15 is a top view of the heating assembly of FIG. 14.

This same variant can be seen in a top view in FIG. 15 as well.

In both FIGS. 14 and 15, one can note that the secondary tube 25*h* has a heating element 9*h*, and in this embodiment the secondary tube 25*h* is substantially L-shaped. However, this L shape has an obtuse angle in its inclination. Like the previous embodiment, a lance 12*h* extends inwardly of the secondary tube 25*h* as far as close to said inclination. This lance 12*h* could also extend as far as closer to the fuel outlet 4*h*.

In case of the lances of the present embodiment have the same power as the lances of the previous embodiment; more heat will be transferred to the fuel, since the present heating assembly has more heating elements.

Notwithstanding, the secondary tubes are positioned both at the ends of the main tube 24*h* and at the central portion thereof. This positioning may have different configurations, depending on the type of internal combustion engine that has to be fed. In other words, the engine design influences the positioning of the secondary tubes 25*h*.

Further, one can observe that a heat transfer region 19*h* is formed inside each secondary tube 25*h*, so that this region has a smaller volume than the whole contained volume of the fuel rail. So, only a part of the fuel is duly heated depending on the restriction of the heat and fuel that flows to said region.

In the same way as cited previously, this reduced but sufficient and duly heated volume enables the desired functioning of the internal combustion engine.

Figure 16:
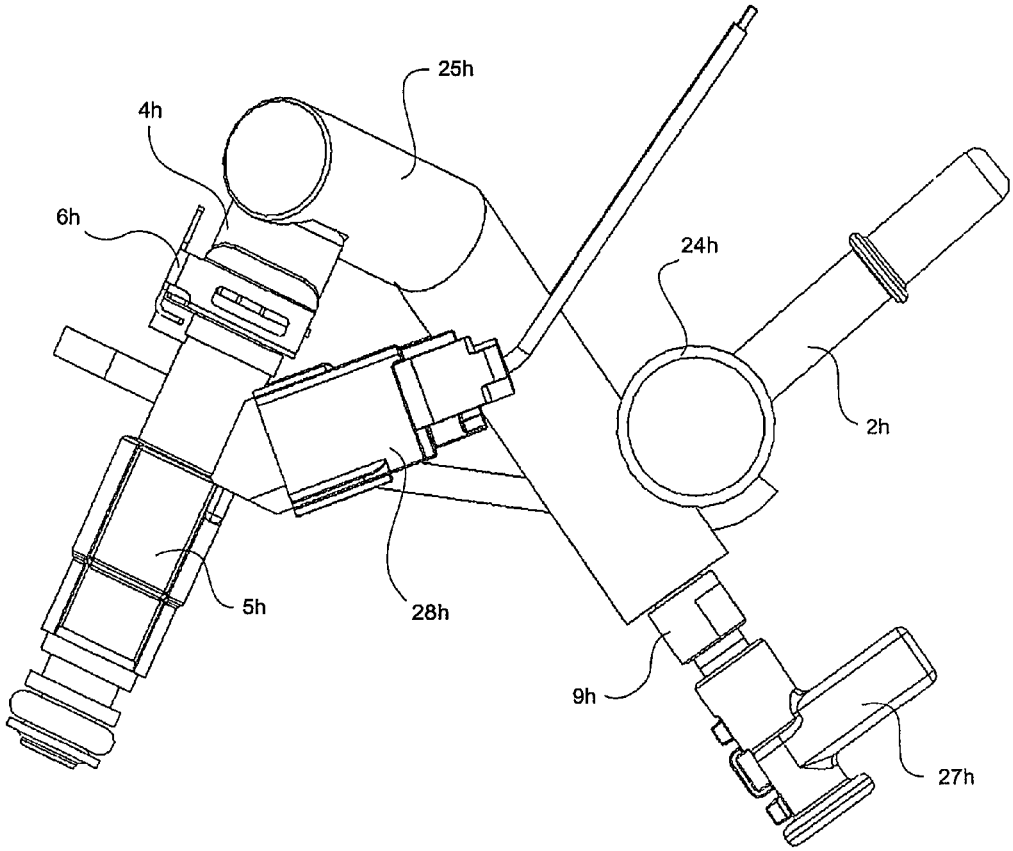
FIG. 16 is a side view of the heating assembly of FIG. 14.

A side view of the present embodiment can still be seen in FIG. 16. In this view one can clearly observe the inclination positioning of the heating assembly. The heating element 9*h* is inserted into a lower portion of the secondary tube 25*h* opposite to the fuel flow direction, thus a heating concentration takes place where the heating element is inserted, since the fuel is gradually heated as it flows, because it is in contact with the lance of the heating element 9*h*. This allows the part in which the lance 12*h* is connected with the heating element, that is, its base, to be less heated. In this way one drastically minimizes the failures presented by overheating of the heating element, thus ensuring the correct functioning and robustness of the heating assembly of the present invention.

The pressurized fuel, upon entering into the secondary tube 25*h*, flows in a direction opposite the force of gravity and is heated as it comes into contact with the lance 12*h* of the heating element 9*h*. In this way the colder fuel, upon entering into the heat transfer region 19*h*, is closer to the place where the heating element 9*h* is inserted. This minimizes further the problems with overheating of the heating element 9*h*.

In addition, since the heated fuel tends to rise, this positioning ensures that the fuel that is more heated in the heat transfer region 19*h* is the one that enters into the injection valve 5*h*.

This positioning of the heating element 9*h* in a lower part of the secondary tube 25*h* prevents a number of drawbacks relating to the heating of the element itself, as well as brings about a better distribution of heat to the fuel to be heated.

As mentioned before, the connector 27*g*, 27*h* supplies electric energy to the heating element in order to change it latter into thermal energy, this connector having only the positive pole. The negative connection (or ground) is effected by the body of the fuel rail itself, which is often made of an electricity conducting material.

Figure 17:
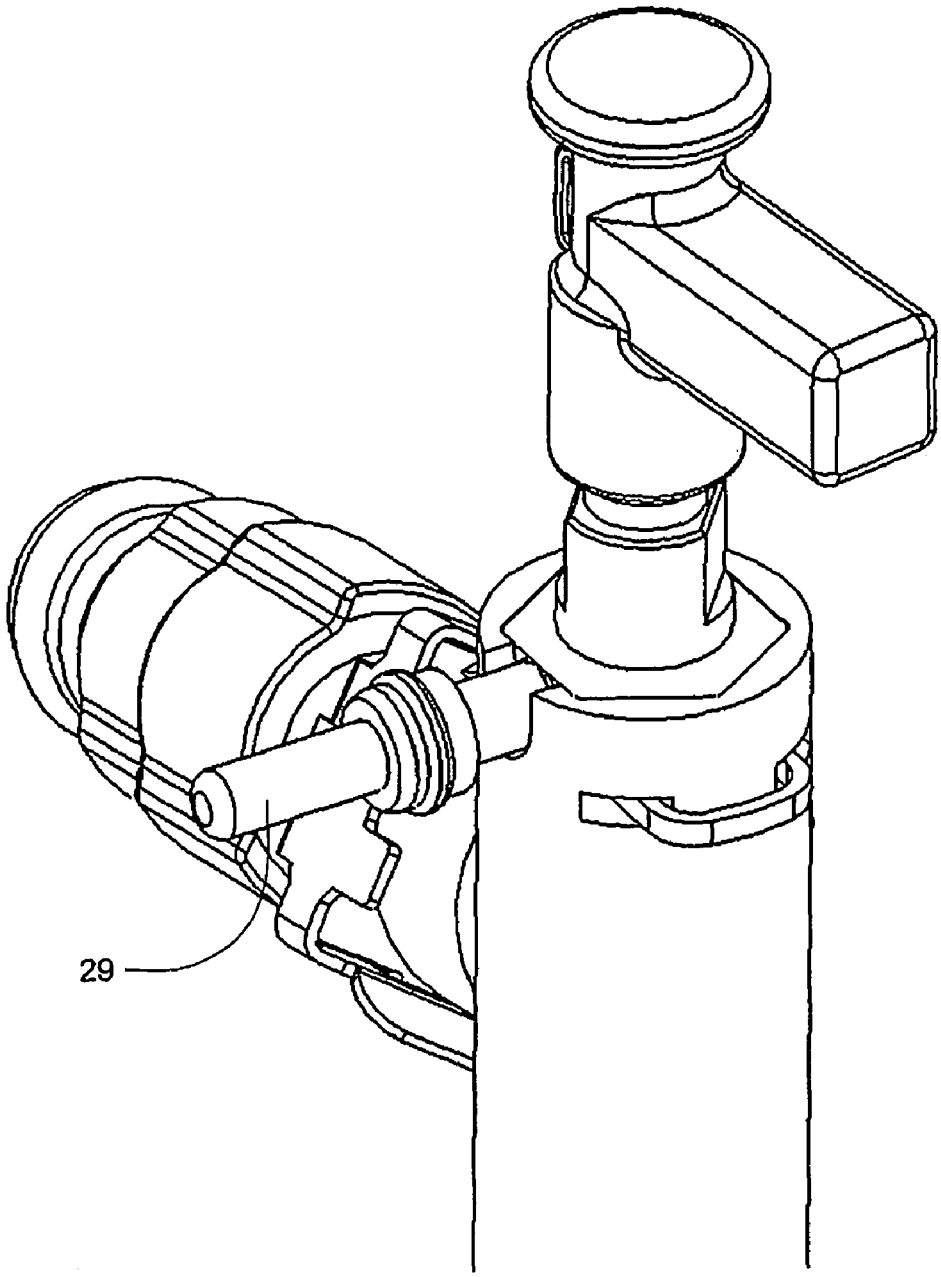
FIG. 17 is an enlarged perspective view of a detail of the heating assemblies.

However, the fuel rail may be manufactured from a material that does not conduct electricity, as for example, plastic. For this type of material, a connector 29 is necessary, as shown in FIG. 17, which is attached to the heating element so as to provide grounding (it can be considered as a negative pole). In this way electric energy is adequately supplied to the heating element in the event that the material applied to the fuel rail is not electricity conducting one.

Figure 18:
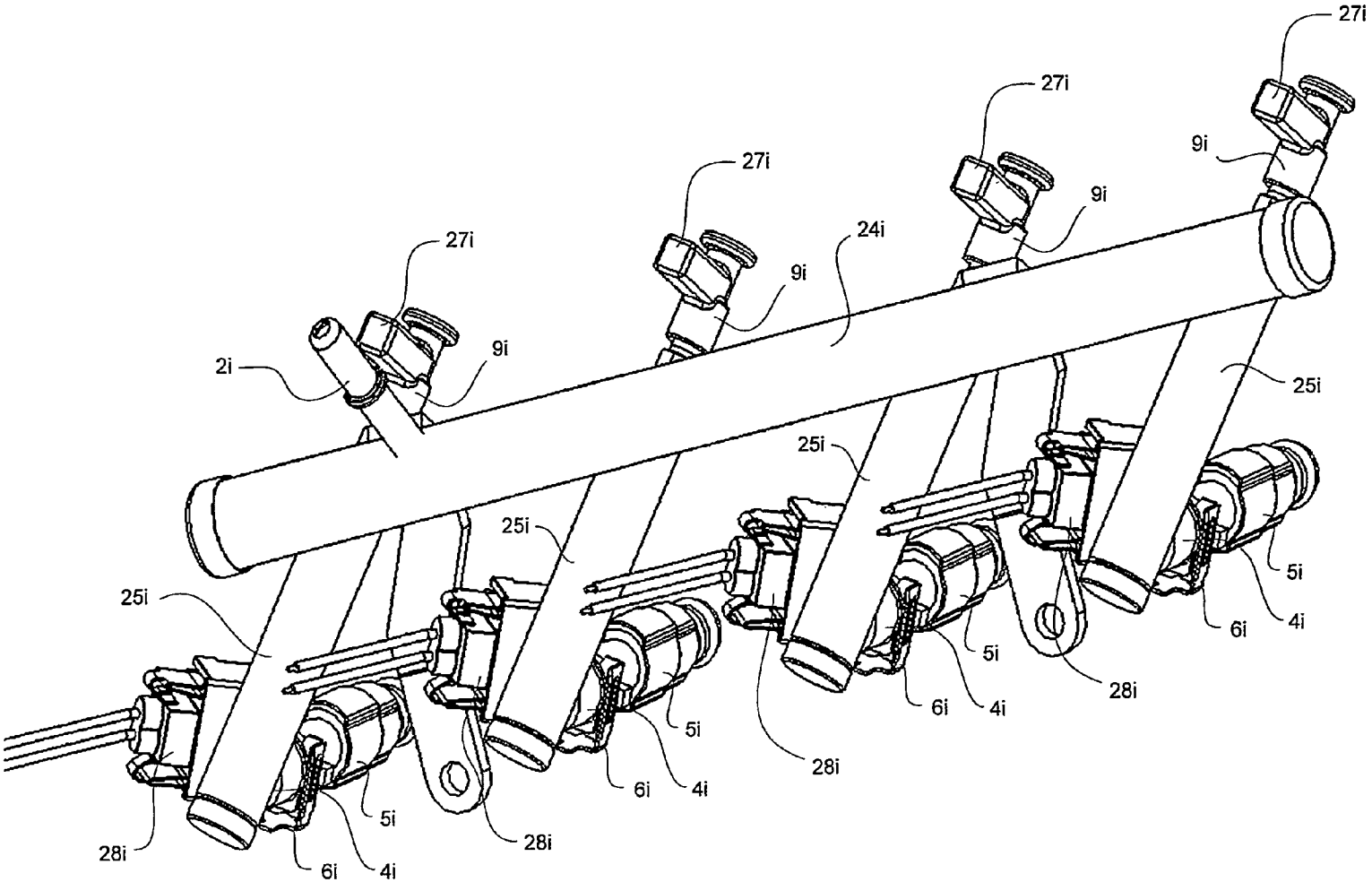
FIG. 18 is a perspective view of a heating assembly.

Finally, a last embodiment of the present invention can be seen in FIG. 18. This embodiment is quite similar to one of the embodiments of the previous heating assembly, but it has some significant differences, mainly as far as the positioning of the heating element is concerned.

Some components of the previous embodiments, as for example, the connectors 27, 28 and the clamps 6, perform the same function.

This embodiment is in position different from those presented before, but, as pointed out above, it has connectors 27*i*, 28*i* and clamps 6*i*, like the other embodiments.

In said FIG. 18, a fuel rail comprises a main tube 24*i*, which has a fuel inlet 2*i*. This inlet is connected to a fuel pressurization system, which naturally supplies pressurized fuel from a fuel tank.

The supplied fuel flows from the fuel inlet 2*i* through the main tube 24*i* as far as at least one injection valve 5*i*. This valve performs the function of spraying fuel for feeding an internal combustion engine.

However, before the fuel reaches the injection valve 5*i*, after coming out of the main tube 24*i*, it passes through a secondary tube 25*i*. In this secondary tube 25*i* there is a heat transfer region 19*i*, which can be better viewed in the next figures.

Figure 19:
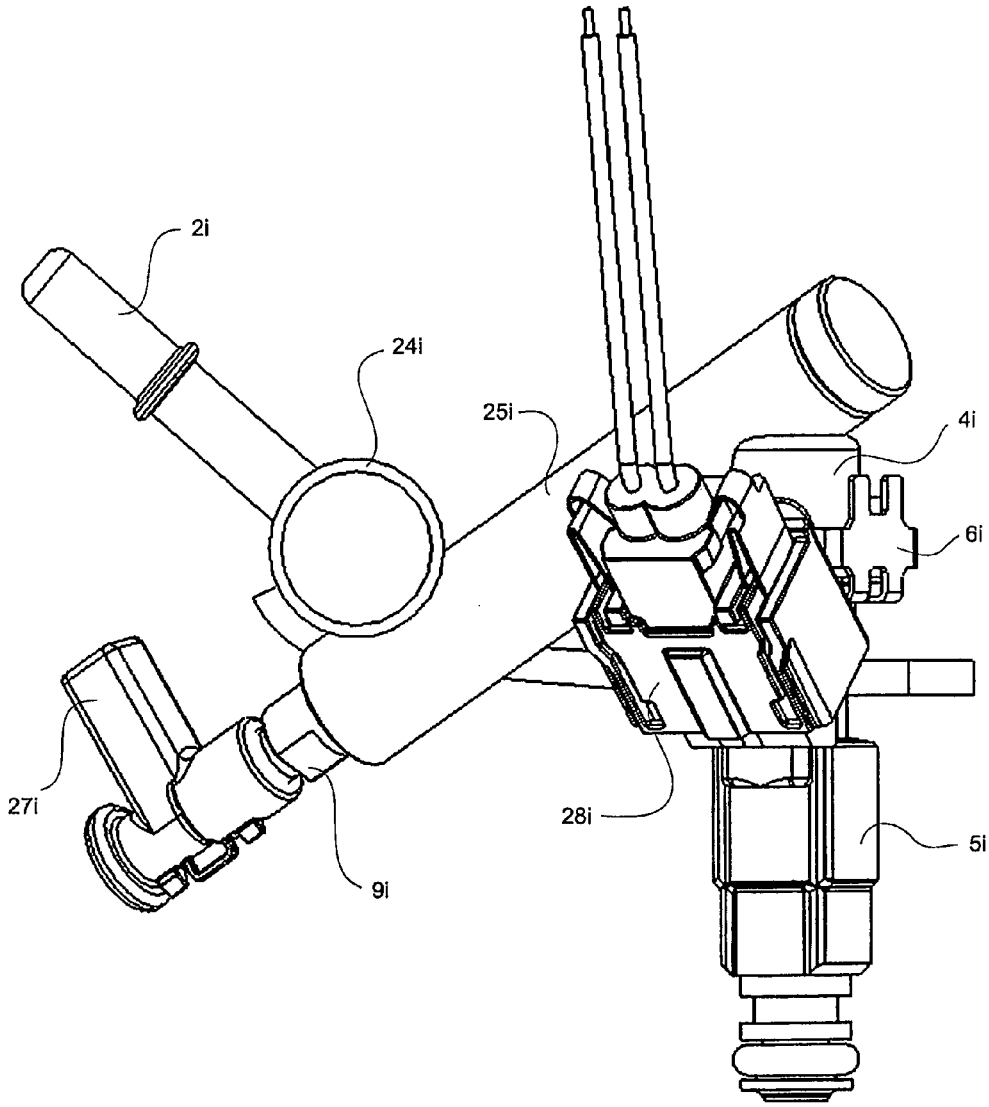
FIG. 19 is a side view of the heating assembly of FIG. 18.
Figure 20:
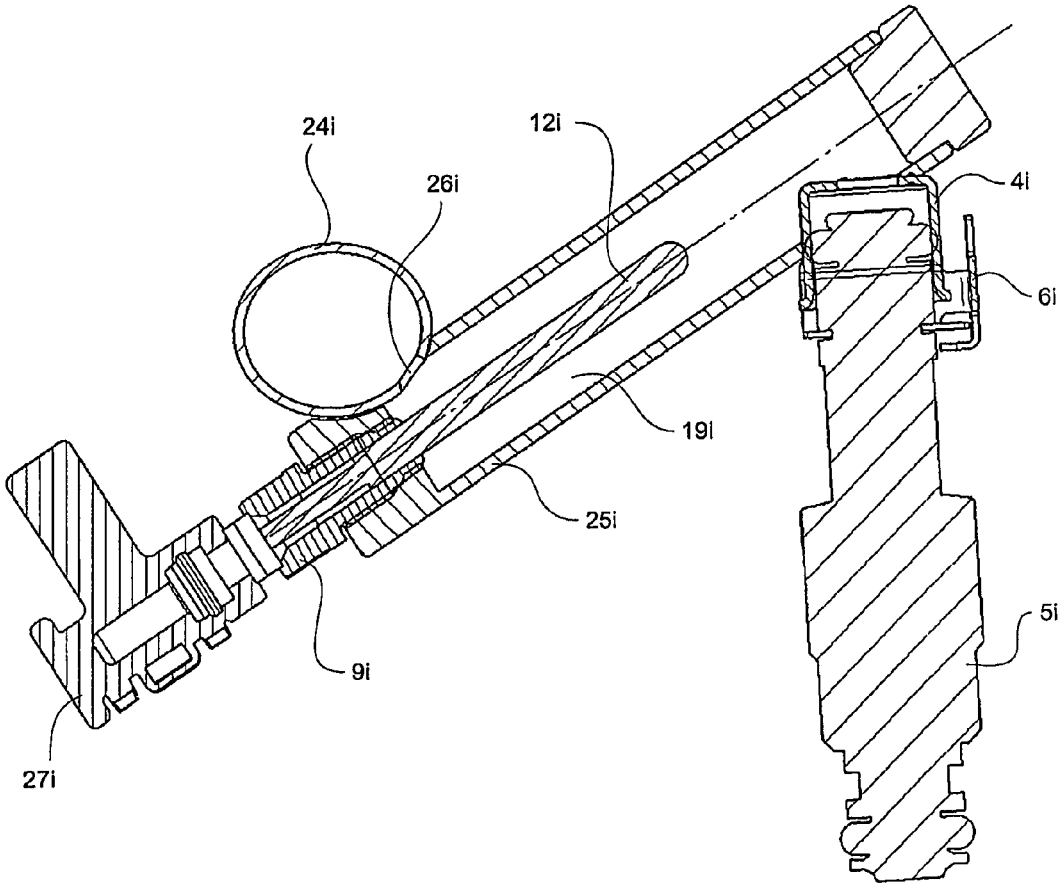
FIG. 20 is a section of the heating assembly of FIG. 18.

FIGS. 19 and 20 disclose the heating assembly of FIG. 7CA in side views, the second one being represented in section.

In these figures the injection valve 5*i* is connected to a fuel outlet 4*i*, the valve being retained at the outlet by means of the clamp 6*i*.

One should note that the injection valve 5*i* is in fluid communication both with the secondary tube 25*i* and with the main tube 24*i*, which substantially form the fuel rail. In this regard, the fuel that comes out of the main tube 24*i* passes through a communication bore 26*i*, which restricts its access to the secondary tube 25*i*.

Inside this latter tube the fuel is heated by the heating element 9*i*, more precisely by the lance 12*i* of said element, in the heat transfer region 19*i*. This region is comprised within the secondary tube 25*i*, so that a part of the fuel comprised in the rail is heated. In this way, one guarantees an adequate volume of heated fuel that, after passing through the heat transfer region 19*i*, flows out of the outlets 4*i* until it is injected into an internal combustion engine through the injection valve 5*i*.

As disclosed in the previous embodiments, the heating element 9*i* is fitted into a lower portion of the secondary tube 25*i* close to the communication bore 26*i*. So, the lance 12*i* extends close to the communication bore 26*i* in the direction of the fuel flow. This fuel flow is in the direction of the fuel outlet 4*i*.

Upon coming into contact with the lance 12*i*, the fuel begins to receive heat in the heat transfer region 19*i*, this region being delimited in this embodiment by the secondary tube 25*i*. Thus, the volume of fuel is duly heated in said region.

Since the first portion of fuel that enters into the heat transfer region 19*i* is at a lower temperature and close to the base of the heating element 9*i*, from which the lance 12*i* extends, the heating element is not subjected to high temperatures. Consequently, this element does not present overheating failures, so that the assembly becomes reliable, robust and of high efficiency.

For the event that the heating takes place before starting the internal combustion engine, that is to say, without there being fuel flow, the fuel in the heat transfer region 19*i* follows in the direction opposite the gravity, because it is at a higher temperature. Since this more heated fuel tends to rise, which fuel at a lower temperature tends to follow the direction of gravity and to occupy the space close to the communication bore 26*i*.

However, the communication bore 26*i* is opposite to the fuel outlet 4*i* and close to a lower portion of the secondary tube 25*i*. In this way, the fuel passed through the heat transfer region 19*i* in a rising manner. Since the more heated fuel tends to rise within the secondary tube 25*i*, one guarantees that the fuel that will pass through the fuel outlet 4*i* towards the injection valve 5*i* is the one that is at a higher temperature.

In addition, in formation of gas during the heating, that is to say, when the fuel passed from the liquid state to the gaseous state, one further ensures that this gas will be as far as possible from the heating element 9*i*. This prevents the lance 12*i* from remaining in contact with the fuel in gaseous state, thus preventing overheating.

The heating element 9, in the above described embodiments, may be a glow plug, as well as a ceramic material resistance with a positive temperature coefficient (PTC), thus providing a precise control of the heating temperature in proportion to the applied current.

With the embodiments of the assembly thus shown it is possible to heat the fuel before the start of the internal combustion engine, in such a way that enough thermal energy is supplied so that the adequate volume of fuel, contained at the heat transfer region 19 reaches the necessary temperature. That allows the desired start, and after the start, the heat can still by degrees be supplied to the fuel, allowing thus that the air/fuel blend to be close to stoichimetric. This continuity in the heat supply to the fuel, even after the adequate start of the internal combustion engine, reduces the emissions, mainly HC.

It must be further noticed that the alterations so presented do not require significant modifications in the project of a current engine, thus they can be carried out at a low cost. Further, the mounting of the assembly makes the maintenance of the components thereof easy, in case the eventual replacement thereof is necessary.

As mentioned, the pre-heating time of the fuel before the start of the internal combustion engine is of great importance, once the user does not wait, or does not want to wait for a long time for the pre-heating period. This time is relatively short, as it is started as soon as there is an intention of the user in turning the engine on (generally by rotating the ignition key until the actuation of the electrical part of the engine) until the start of the engine itself.

Thus, this invention comprises a method for the pre-heating of fuel for an internal combustion engine, which uses the heating assembly as described hereinabove.

In the engines in which there is a pre-heating time, usually diesel engines, there is a light sign on an instrument panel which indicates a minimal time in which the user must wait for pre-heating.

It happens that in Otto cycle the user is not used to such procedure. Thus, probably, the pre-heating would not occur in an efficient way.

In order to avoid the necessity of an active intervention of the user to the correct performing of the pre-heating, the present method performs the pre-heating of fuel without the user being aware of his intervention.

Normally, engines, so far described, are present in a vehicle, that is, an automobile. When there is the intention of the user in starting the engine of said automobile, he will have to open the door of the automobile. With this door opening, a relay connected to an electronic unit sends the information that the door has been opened. This allows the electronic unit to receive the information of a possible intention of starting the internal combustion engine. So, the electronic unit actuates the fuel heating assembly before even the insertion of the key in the ignition command of the automobile.

Thus, some further heating seconds, before the engine starts are obtained. This is a significant difference for a satisfactory pre-heating.

The actuation of the heating assembly may be carried out by other factors, such as, for example, the deactivation of the alarm of the automobile or even, the unlocking of the doors by remote control. The important is that the electronic unit receives the information of a possible intention from the user in willing to start the internal combustion engine and that, thus, the electronic unit may activate the heating assembly. It is also important that the user make his intervention in an unconscious way, so that his interactivity is not required in the present method.

But, before the actuation performed by the electronic unit, the latter verifies if the external temperature is such that requires in fact a pre-heating of the fuel inside rail 1. A programming of the minimal temperature may be performed at the unit, so that there is the actuation of the pre-heating starting from this temperature as, for example, at temperatures below 20° C.

After a pre-heating of the fuel, the user starts the internal combustion engine of the automobile, in such a way that the electronic unit keeps the heating assembly still active for approximately 1 minute, even after the start. This drastically minimizes the emissions of pollutants emission, mainly HC, once the blend air/fuel comes close to the stoichimetric more quickly.

Naturally, the time of permanence in which the heating assembly remains active is calculated in relation to the external temperature, this time varying for each type of engine to which the assembly is applied.

In synthesis, the present method is comprised by the following steps:

I—User intervention, as, for example, by opening the door of the automobile or turning the alarm of the vehicle off by remote control;

II—Receiving of information of the intervention by the user by the electronic unit;

III—Pre-heating of the fuel by the heating assembly actuated by the electronic unit;

IV—Start of the internal combustion engine performed by the user after pre-heating; and V—Continuous heating of the fuel by the heating assembly, during a determined programmed time at the electronic unit after the start of the engine for the reduction of the emissions of pollutants, this interval can be, for example, of 1 minute.

It must be noted that the heating of the heating assembly happens independently of the actuation of other components of the automobile, as, for example, operation of the fuel pump or injection valves, before the internal combustion engine is turned on.

If by any reason after the preheating of the fuel the internal combustion engine is not turned on, the electronic unit deactivates the operation of the heating assembly in order to prevent the discharge of the battery of the automobile.

Furthermore, the user can receive a sign from the electronic unit, which informs that the fuel is properly pre-heated before the start of the internal combustion engine, what will comply with the requirements mentioned above, that is, an ideal start of the internal combustion engine. This sign can be a sound sign, or even a light indication at the panel of the automobile.

The two preferred examples of embodiments having been disclosed, it must be understood that the scope of the present invention encompasses other possible variations, being limited only by the content of the appended claims, there included possible equivalents.

The invention claimed is:

1. A fuel-heating assembly for an internal combustion engine, comprising:

a fuel rail having a main tube that defines a fuel inlet through which pressurized fuel is admitted into the main tube;

the fuel rail defining a heat transfer region having a volume smaller than a total volume of the fuel rail, and further defining a communication orifice between the main tube and the heat transfer region through which fuel in the main tube is admitted into the heat transfer region;

the fuel rail further defining a fuel outlet for the heat transfer region arranged such that fuel is discharged from the heat transfer region through the fuel outlet for supply to an injection valve of an internal combustion engine; and a heating element inserted in the fuel rail and positioned such that fuel admitted into the heat transfer region is heated by the heating element prior to being discharged through the fuel outlet;

wherein the fuel rail is configured such that when the fuel rail is in use on an internal combustion engine the communication orifice is located in a lower position than the fuel outlet so that heated fuel flows from the communication orifice through the heat transfer region and to the fuel outlet in a direction contrary to gravitational force.

2. The fuel-heating assembly of claim 1, for use with an internal combustion engine having a plurality of injection valves, the fuel rail defining a plurality of heat transfer regions each having a volume smaller than a total volume of the fuel rail, and communication orifices between the main tube and each heat transfer region through which fuel in the main tube is admitted into the heat transfer regions, wherein the fuel rail defines a fuel outlet for each heat transfer region arranged such that fuel is discharged from each heat transfer region through the respective fuel outlet for supply to a respective injection valve;

a plurality of heating elements being inserted in the fuel rail and positioned such that fuel admitted into each heat transfer region is heated by the respective heating element prior to being discharged through the respective fuel outlet; and the fuel rail being configured such that when the fuel rail is in use on an internal combustion engine the communication orifices are located in lower positions than the respective fuel outlets so that heated fuel flows upwardly from the communication orifices through the heat transfer regions and to the fuel outlets.

3. The fuel-heating assembly of claim 1, wherein a portion of the heating element to which the fuel in the heat transfer region is exposed is elongated along an axis, and the heating element is arranged such that said axis is parallel to a direction of flow of the fuel in the heat transfer region.

4. The fuel-heating assembly of claim 1, wherein the heating element has a heat lance inserted in the fuel rail.

5. The fuel-heating assembly of claim 4, wherein the heat lance is of ceramic material having a positive temperature coefficient.

6. The fuel-heating assembly of claim 4, wherein the fuel rail defines an opening in which the heat lance is inserted.

7. The fuel-heating assembly of claim 1, wherein the heating element comprises a glow plug.

8. The fuel-heating assembly of claim 1, further comprising an injection valve in fluid communication with the fuel outlet, wherein the injection valve defines an internal volume for fuel that is smaller than the volume of the heat transfer region.

9. The fuel-heating assembly of claim 1, further comprising an injection valve in fluid communication with the fuel outlet, wherein the heating element is mounted on the fuel rail opposite from the injection valve.

10. The fuel-heating assembly of claim 1, the fuel rail further comprising internal fins arranged in the fuel rail so as to partially separate the heat transfer region from a remainder of the volume of the fuel rail.

11. The fuel-heating assembly of claim 10, wherein a portion of the heating element to which the fuel in the heat transfer region is exposed comprises a lance that is elongated along an axis, and wherein the fins follow an axial direction of the lance.

12. The fuel-heating assembly of claim 10, wherein the fins are proximate the fuel outlet.

13. The fuel-heating assembly of claim 10, wherein the fins are in the form of a U-profile.

14. The fuel-heating assembly of claim 1, wherein the fuel rail includes a secondary tube connected to the main tube for receiving fuel therefrom, the heat transfer region being defined in the secondary tube, the secondary tube defining the fuel outlet, and the heating element being inserted in the secondary tube.

15. The fuel-heating assembly of claim 14, wherein the communication orifice is between the main tube and the secondary tube and restricts fuel flow from the main tube to the secondary tube.

16. The fuel-heating assembly of claim 15, wherein the heating element includes a lance that is elongated along an axis, the lance being arranged such that the axis follows an axial direction of the secondary tube.

17. The fuel-heating assembly of claim 15, wherein the fuel outlet is located intermediate opposite ends of the secondary tube.

18. The fuel-heating assembly of claim 17, wherein one end of the secondary tube is connected to the main tube and the other end of the secondary tube is remote from the main tube, and the heating element is inserted into said other end remote from the main tube.

19. The fuel-heating assembly of claim 9, wherein the heating element includes a lance that is elongated along an axis, and wherein the lance extends into a fuel inlet of the injection valve.

20. The fuel-heating assembly of claim 9, wherein the heating element includes a lance that is elongated along an axis, and wherein a distal end of the lance faces and is spaced from a fuel inlet of the injection valve.

21. The fuel-heating assembly of claim 18, wherein the secondary tube is arranged with respect to the heating element such that the heating element is inserted into the secondary tube in a direction opposite to a direction of fuel flow in the secondary tube.

22. The fuel-heating assembly of claim 14, wherein the secondary tube is Y-shaped.

23. The fuel-heating assembly of claim 22, wherein one leg of the Y-shaped secondary tube defines one fuel outlet and another leg of the Y-shaped secondary tube defines another fuel outlet, and further comprising injection valves respectively connected to the legs in respective fluid communication with the fuel outlets.

24. The fuel-heating assembly of claim 14, wherein the heating element includes a lance that is elongated along an axis, and wherein the lance extends in a direction toward the fuel outlet such that a portion of the lance is proximate the fuel outlet.

25. The fuel-heating assembly of claim 14, comprising a plurality of secondary tubes each connected to the main tube and each defining a fuel outlet for a respective injection valve, wherein the secondary tubes are spaced apart along a length of the main tube.

26. The fuel-heating assembly of claim 14, wherein the secondary tube is arranged such that fuel in the secondary tube flows toward the fuel outlet in a direction contrary to the gravitational force.

27. The fuel-heating assembly of claim 14, wherein the secondary tube connects to the main tube at an intermediate location along a length of the secondary tube, a lower end of the secondary tube being located lower than said intermediate location, the fuel outlet of the secondary tube being located higher than said intermediate location.

28. The fuel-heating assembly of claim 27, wherein the heating element includes a lance that is elongated along an axis, the lance being inserted into the lower end of the secondary tube with the axis oriented lengthwise along the secondary tube.

29. The fuel-heating assembly of claim 27, wherein an upper portion of the secondary tube branches into two legs each defining a respective fuel outlet for a respective injection valve, and the heating element serves to heat the fuel for both injection valves.

30. The fuel-heating assembly of claim 1, further comprising an electrical connector connected to the heating element.

* * * * *

UNITED STATES PATENT AND TRADEMARK OFFICE

CERTIFICATE OF CORRECTION

PATENT NO. : 7,942,136 B2
APPLICATION NO. : 11/921696
DATED : May 17, 2011
INVENTOR(S) : Lepsch et al.

It is certified that error appears in the above-identified patent and that said Letters Patent is hereby corrected as shown below:

Title page, Item (54) and Column 1, lines 1-3,
"FUEL-HEATING ASSEMBLY AND METHOD FOR THE PRE-HEATING OF FUEL AN INTERNAL COMBUSTION ENGINE" should read --FUEL-HEATING ASSEMBLY AND METHOD FOR THE PRE-HEATING OF FUEL OF AN INTERNAL COMBUSTION ENGINE--;

Item (76) Inventors: "Fernando Lepsch, Campinas (BR); Fernando Marron, Salto (BR); Franz Thommes, Alemanha (DE); Rosalvo Bertolucci Filho, Campinas (BR); Alvaro Augusto Vasconcelos, Bairro Chacara Primavera (BR); Marcos Melo Araujo, Campinas (BR); Marcello Francisco Brunocilla, Indaiatuba (BR)" should read --Fernando Lepsch, Campinas (BR); Fernando Marron, Salto (BR); Franz Thommes, Bietigheim-Bissingen (DE); Rosalvo Bertolucci Filho, Campinas (BR); Alvaro Augusto Vasconcelos, Campinas (BR); Marcos Melo Araujo, Campinas (BR); Marcello Francisco Brunocilla, Indaiatuba (BR)--.

Column 6
Line 6, "the rail la supplies" should read --the rail 1a supplies--;
Line 36, "rail la" should read --rail 1a--.

Column 8
Line 11, "a lager amount" should read --a larger amount--.

Signed and Sealed this
First Day of May, 2012

David J. Kappos

David J. Kappos
*Director of the United States Patent and Trademark Office*